US008881483B2

(12) United States Patent
Caboni

(10) Patent No.: US 8,881,483 B2
(45) Date of Patent: Nov. 11, 2014

(54) VARIABLE-GEOMETRY MODULAR STRUCTURE COMPOSED OF THERMO-ACOUSTIC CAISSONS, PARTICULARLY FOR BUILDINGS

(76) Inventor: Michele Caboni, Oristano (IT)

( * ) Notice: Subject to any disclaimer, the term of this patent is extended or adjusted under 35 U.S.C. 154(b) by 0 days.

(21) Appl. No.: 13/989,930

(22) PCT Filed: Nov. 24, 2011

(86) PCT No.: PCT/IT2011/000385

§ 371 (c)(1),
(2), (4) Date: May 28, 2013

(87) PCT Pub. No.: WO2012/070079

PCT Pub. Date: May 31, 2012

(65) Prior Publication Data

US 2013/0239499 A1 Sep. 19, 2013

(30) Foreign Application Priority Data

Nov. 25, 2010 (IT) ..... MI2010A2187

(51) Int. Cl.
*E04B 2/00* (2006.01)
*E04B 1/76* (2006.01)

(Continued)

(52) U.S. Cl.
CPC ..... *E04B 1/762* (2013.01); *E04B 1/7629* (2013.01); *E04B 1/90* (2013.01); *E04B 2/18* (2013.01); *E04B 2/8641* (2013.01); *E04C 1/40* (2013.01); *E04F 13/007* (2013.01); *E04B 2002/0223* (2013.01); *E04B 5/026* (2013.01); *E04B 5/21* (2013.01); *E04B 5/43* (2013.01); *E04C 5/20* (2013.01)
USPC ..... 52/592.3; 52/426

(58) Field of Classification Search
USPC ..... 52/379, 777, 779, 512, 513, 592.3, 52/592.5, 592.6, 426, 427, 428, 506.08, 52/309.12, 562, 564, 568
See application file for complete search history.

(56) References Cited

U.S. PATENT DOCUMENTS 3,151,391 A 10/1964 Ollier
3,832,816 A * 9/1974 Jahn ..... 52/779

(Continued)

FOREIGN PATENT DOCUMENTS

CA 2264099 2/1998
CH 367966 3/1963

(Continued)

OTHER PUBLICATIONS

International Search Report for PCT/IT2011/000385, Completed by the European Patent Office on Jun. 5, 2013, 3 Pages.

*Primary Examiner* — Brian Glessner
*Assistant Examiner* — Paola Agudelo
(74) *Attorney, Agent, or Firm* — Brooks Kushman P.C.

(57) ABSTRACT

A variable-geometry modular structure made of a metallic or plastic alloy, having at least one modular element with variable-geometry, with a honey-comb structure, to be joined to different modular components to obtain different embodiments. The modular element has a series of passages in which vacuum is created when manufacturing, through molding or extrusion, the modular element itself; the above modular element is a structural element and has at the same time insulating characteristics. The external surfaces of the modular element have a series of recesses and ribs, shaped as a dovetail, that allow mutually joining two or more elements. Modular elements can further be butt-joined by using posts arranged next to the passages. The modular element can be joined to a panel which has a substantially smooth or a corrugated external surface, which is used for applying plaster or other finishing elements, such as any type photovoltaic panels or tiles.

14 Claims, 21 Drawing Sheets

(51) Int. Cl.

| | |
|---|---|
| ***E04B 1/90*** | (2006.01) |
| ***E04B 2/18*** | (2006.01) |
| ***E04B 2/86*** | (2006.01) |
| ***E04C 1/40*** | (2006.01) |
| ***E04F 13/00*** | (2006.01) |
| *E04B 2/02* | (2006.01) |
| *E04B 5/02* | (2006.01) |
| *E04B 5/21* | (2006.01) |
| *E04B 5/43* | (2006.01) |
| *E04C 5/20* | (2006.01) |

(56) References Cited

U.S. PATENT DOCUMENTS

| | | | | |
|---|---|---|---|---|
| 3,969,865 | A * | 7/1976 | Andersen | 52/506.07 |
| 4,136,798 | A | 1/1979 | Oberstein | |
| 4,255,910 | A * | 3/1981 | Wendt | 52/481.2 |
| 4,472,331 | A | 9/1984 | Kida | |
| 4,731,968 | A * | 3/1988 | Obino | 52/309.12 |
| 4,833,857 | A | 5/1989 | Wheeler | |
| 4,894,969 | A * | 1/1990 | Horobin | 52/309.12 |
| 5,086,600 | A * | 2/1992 | Holland et al. | 52/592.6 |
| 5,383,319 | A | 1/1995 | Sorqvist | |
| 5,390,459 | A * | 2/1995 | Mensen | 52/426 |
| 5,428,933 | A * | 7/1995 | Philippe | 52/592.1 |
| 5,775,046 | A * | 7/1998 | Fanger et al. | 52/590.1 |
| 5,809,727 | A * | 9/1998 | Mensen | 52/426 |
| 5,890,337 | A * | 4/1999 | Boeshart | 52/426 |
| 5,896,714 | A * | 4/1999 | Cymbala et al. | 52/426 |
| 5,992,108 | A * | 11/1999 | Falcey | 52/220.2 |
| 6,240,692 | B1 * | 6/2001 | Yost et al. | 52/426 |
| 6,370,831 | B1 | 4/2002 | Marshall et al. | |
| 6,374,552 | B1 * | 4/2002 | Price | 52/169.12 |
| 6,401,419 | B1 * | 6/2002 | Beliveau | 52/592.6 |
| 6,668,503 | B2 * | 12/2003 | Beliveau | 52/426 |
| 7,082,732 | B2 | 8/2006 | Titishov | |
| 8,181,414 | B2 | 5/2012 | Garrett | |
| 2004/0103609 | A1 | 6/2004 | Wostal et al. | |
| 2005/0028466 | A1 | 2/2005 | Titishov | |
| 2007/0214740 | A1 | 9/2007 | O'Grady | |
| 2008/0172972 | A1 | 7/2008 | Williams | |
| 2009/0044481 | A1 | 2/2009 | Turek | |
| 2010/0065716 | A1 | 3/2010 | Amend | |

FOREIGN PATENT DOCUMENTS

| | | |
|---|---|---|
| DE | 2013630 | 11/1971 |
| DE | 3410484 | 10/1985 |
| DE | 9418036 | 1/1995 |
| DE | 4332115 | 3/1995 |
| DE | 29611835 | 11/1996 |
| DE | 102008050741 | 4/2010 |
| EP | 0137105 | 4/1985 |
| EP | 0163117 | 12/1985 |
| EP | 0368804 | 5/1990 |
| EP | 0803618 | 10/1997 |
| EP | 1092816 | 4/2001 |
| EP | 1605113 | 12/2005 |
| FR | 663193 | 8/1929 |
| FR | 2328814 | 5/1977 |
| FR | 2813903 | 3/2002 |
| FR | 2874950 | 3/2006 |
| JP | 2002348858 | 12/2002 |
| WO | 9119055 | 12/1991 |
| WO | 03046310 | 6/2003 |
| WO | 2005014948 | 2/2005 |
| WO | 2005035898 | 4/2005 |
| WO | 2005061804 | 7/2005 |
| WO | 2006063140 | 6/2006 |
| WO | 2006081678 | 8/2006 |
| WO | 2008098686 | 8/2008 |

* cited by examiner

VARIABLE-GEOMETRY MODULAR STRUCTURE COMPOSED OF THERMO-ACOUSTIC CAISSONS, PARTICULARLY FOR BUILDINGS

CROSS-REFERENCE TO RELATED APPLICATION

This application is the U.S. national phase of PCT Application No. PCT/IT2011/000385 filed on Nov. 24, 2011, which claims priority to Italian Patent Application No. MI2010A002187 filed on Nov. 25, 2010, the disclosures of which are incorporated in their entirety by reference herein.

The present invention deals with a variable-geometry modular structure composed of thermo-acoustic caissons, particularly for buildings, according to the preamble of Claim 1, as disclosed in document EP-A1-0 163 117.

The variable-geometry modular structure of the present invention has been particularly devised for making: seism-resisting monolithic walls; variable-geometry mono-directional thermo-acoustic roofs and floors; variable-geometry bidirectional thermo-acoustic roofs and floors; thermo-acoustic coats; thermo-acoustic coats with longitudinal and reticular baffles made of structural concrete for reinforcing existing building structures; ventilated thermo-acoustic coats; ventilated thermo-acoustic roofs in extrados made of metallic alloys; thermo-reflecting and thermo-acoustic floors with extrados surfaces made of aluminium films, metallic alloys or plastics, with exclusive transpiring and thermal and acoustic insulation characteristics.

As known, making of variable-geometry modular elements with seism-resisting structural functions, such as the above-listed components, that have high mechanical resistance characteristics and at the same time good transpiration, has always been a very felt problem in civil and industrial buildings worldwide.

Another very felt problem is making variable-geometry seism-resisting modular monolithic structures that can be easily assembled through restraining, and easily laid in reduced times.

Task of the present invention is providing an homogeneous seism-resisting building structure that allows making monolithic walls; variable-geometry mono-directional and bidirectional thermo-acoustic roofs and floors; thermo-acoustic coats; thermo-acoustic coats with longitudinal and reticular baffles made of structural concrete for reinforcing existing building structures; ventilated thermo-acoustic coats; ventilated thermo-acoustic roofs in extrados made of metallic alloys or plastics, and the like, with exclusive transpiring and thermal and acoustic insulation characteristics.

Within this task, object of the invention is providing an homogeneous and modular variable-geometry structure that can be assembled by restraining it with very few elements, and can be easily and quickly laid.

A further object is providing a structure that is homogeneous and thermo-acoustic in all its parts, compose dog light-weight materials, also recycled, to make it easier to transport and lay it, in addition to its static functionality.

The present structure, due to its exclusive and peculiar manufacturing characteristics, is able to ensure with widest guarantees of structural reliability in zones with high seismic risks, and is safe when assembling and laying it.

These and other objects, that will be better pointed out below, are obtained with a variable-geometry modular structure as described in Claim 1.

Such modular structure comprises at least one modular element, with a variable-geometry honey-comb structure, subjected to be joined to different modular components to obtain several embodiments without structural and architectonic constraints; the modular element is made of any plastic material or metallic alloy, and has a series of passages in which vacuum is created when manufacturing, by molding or extrusion, the modular element itself; the above variable-geometry modular element is a structural element has insulating characteristics even with a minimum thickness.

The external surface of the variable-geometry modular element has a series of dovetail-shaped recesses and ribs, that allow mutually joining two or more elements; the above variable-geometry modular elements can further be butt-joined by using male and female posts arranged next to the passages, thereby guaranteeing the element reversibility.

The modular element is joined to a variable-geometry panel made of a metallic or plastic alloy, which has a ribbed or substantially smooth external surface adapted to be mounted at view or a corrugated external surface, which, horizontally placed, is used for snappingly engage further modular elements, or for applying steel armature placed along a longitudinal or reticular direction, with possible cast of a block to create a structurally responding slab, characterizing it with a big thermal mass.

The same modular element is joined to a variable-geometry panel made of a metallic or plastic alloy, which has a ribbed or substantially smooth external surface adapted to be mounted at view, both in a horizontal and in a vertical position, or with a corrugated external surface, which, horizontally placed, is used to make an insulating, thermo-reflecting floor, which, after having housed in the suitable recesses the necessary piping in which sanitary water easily flows, can be easily completed with a cement block in order to complete a perfect plane in which ceramic floors can be directly laid.

The same modular element is joined to a variable-geometry panel made of a metallic alloy which has ribbed or corrugated external surface, which, vertically placed with respect to a resisting wall, is used to make a thermo-reflecting coat at view, plastered or finished with other finishing elements.

The same modular element is joined to a variable-geometry panel made of a metallic alloy, which has a corrugated external surface, which, placed in a vertical or slanted position with respect to an existing floor or slab, is used for making a ventilated or micro-ventilated thermo-reflecting structure, or a structure coated with other finishing elements, such as photovoltaic panels or tiles.

Further characteristics and advantages of the present invention will be better pointed out by examining the description of a preferred, but not exclusive, embodiment thereof, shows as a non-limiting example in the enclosed drawings, in which.

Figure 8:
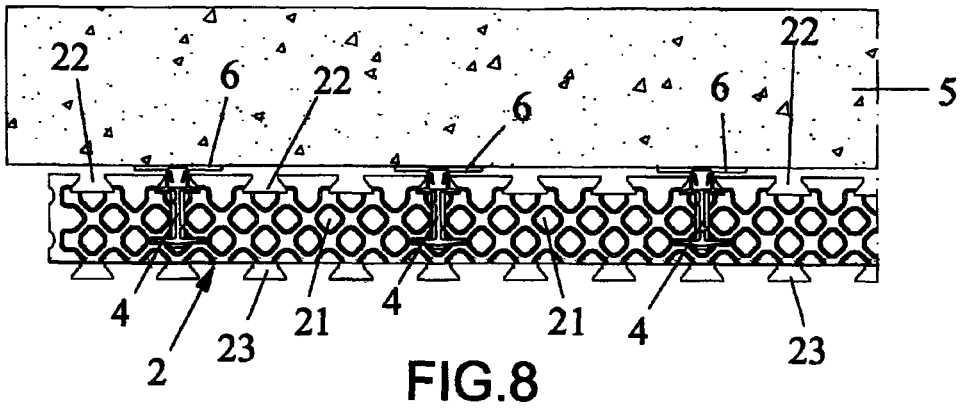
FIG. 8 is a sectional view that show another embodiment of the structure composed of a modular element joined to a concrete wall or a traditional masonry with micro-ventilation.
Figure 11:
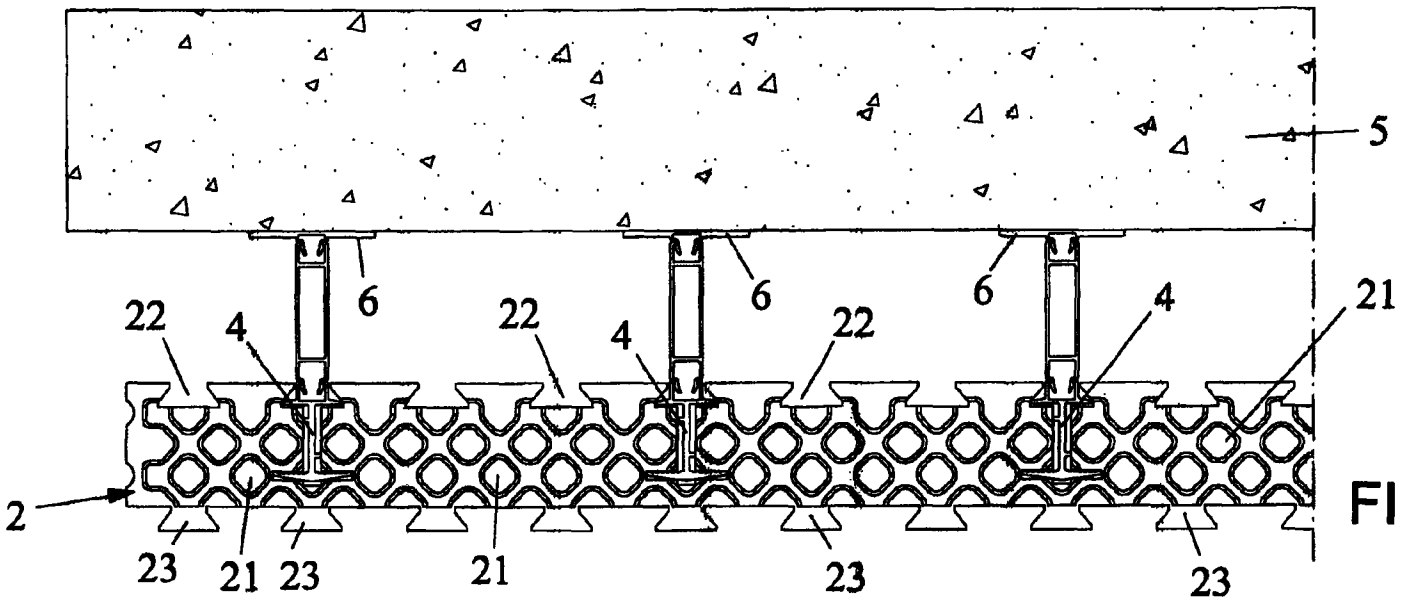
Figure 12:
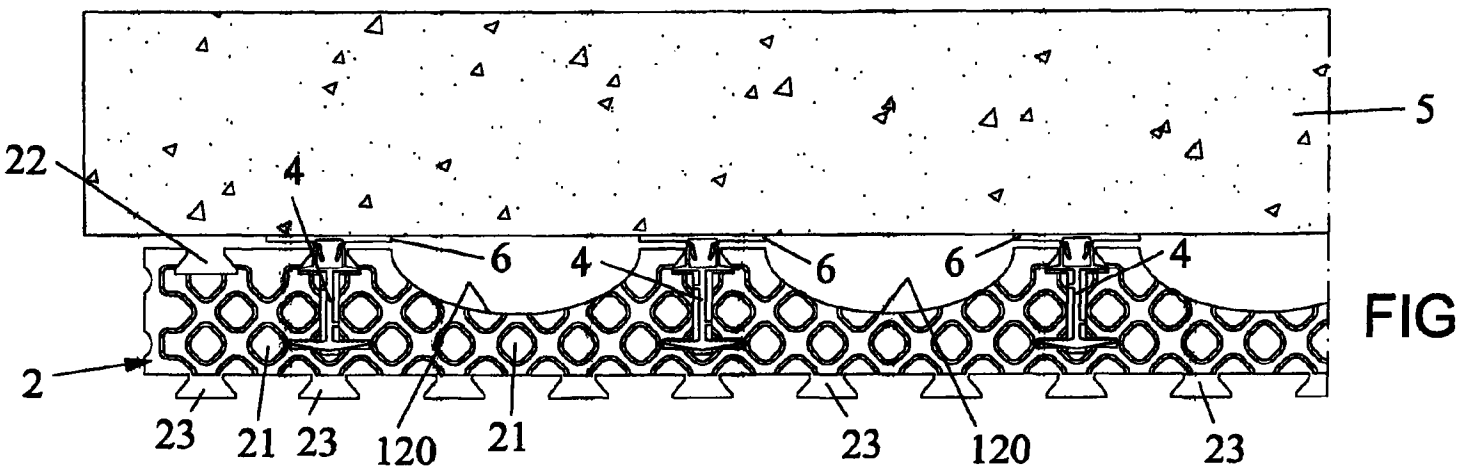
Figure 13:
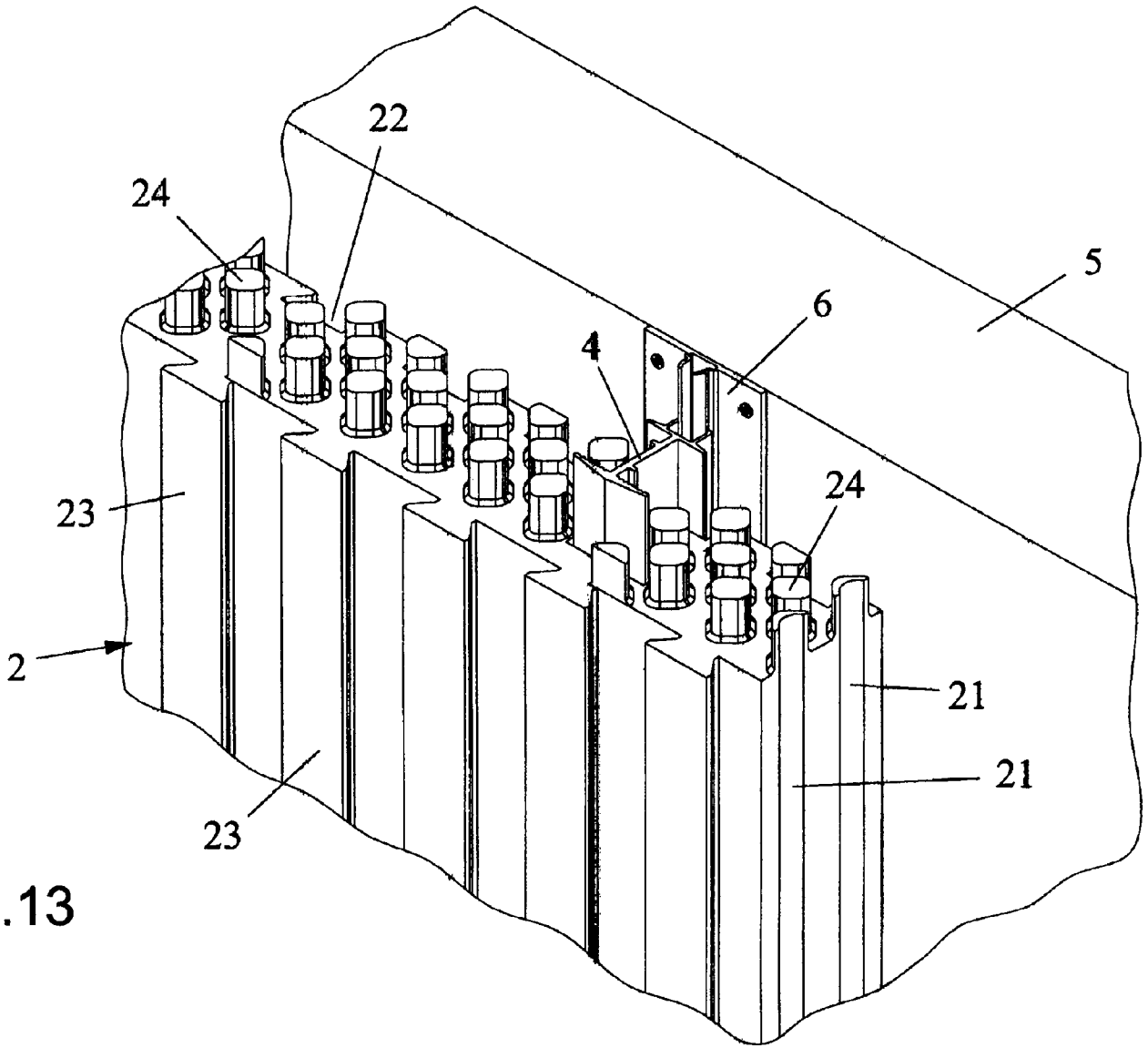
Figure 14:
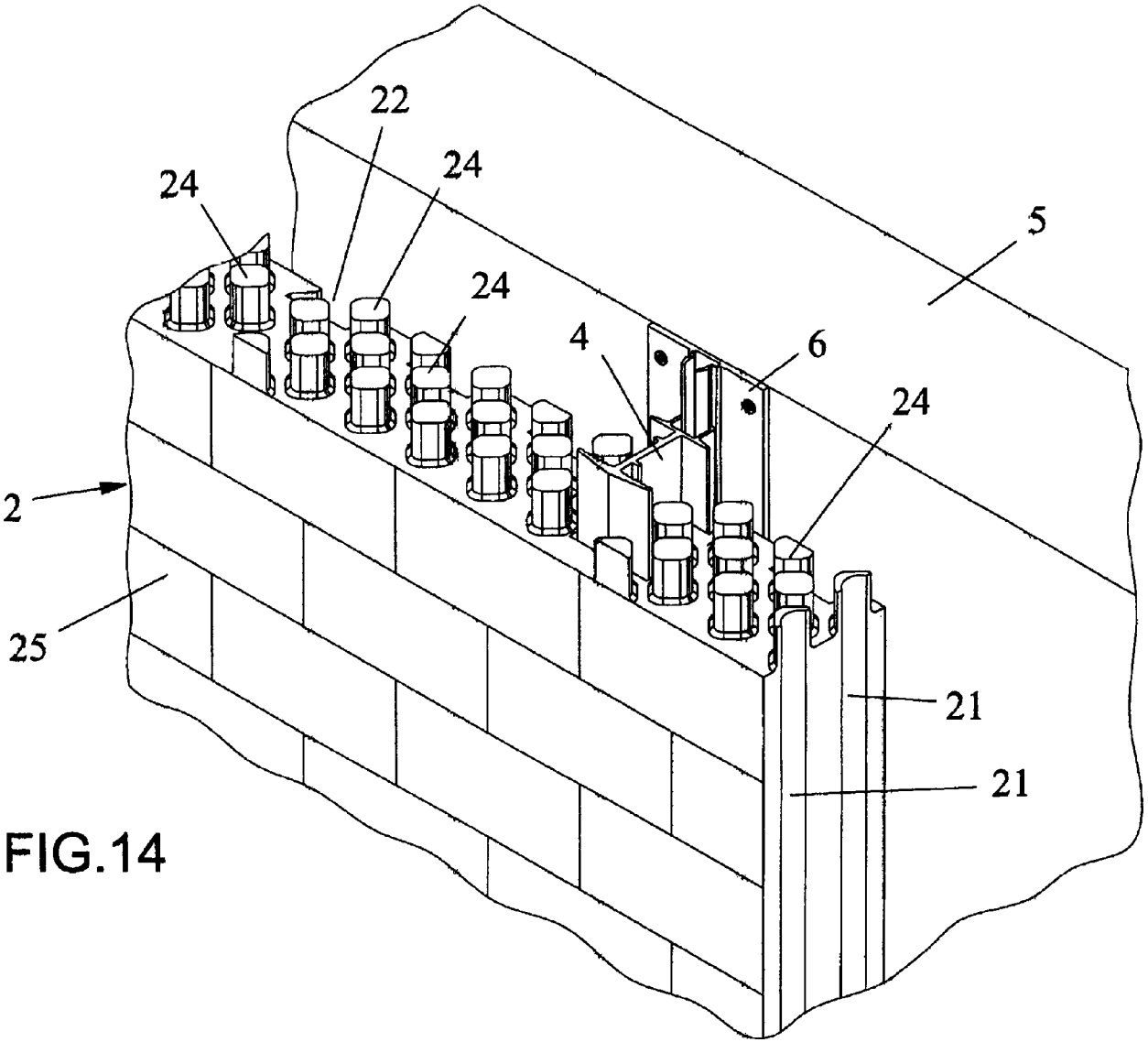
Figure 15:
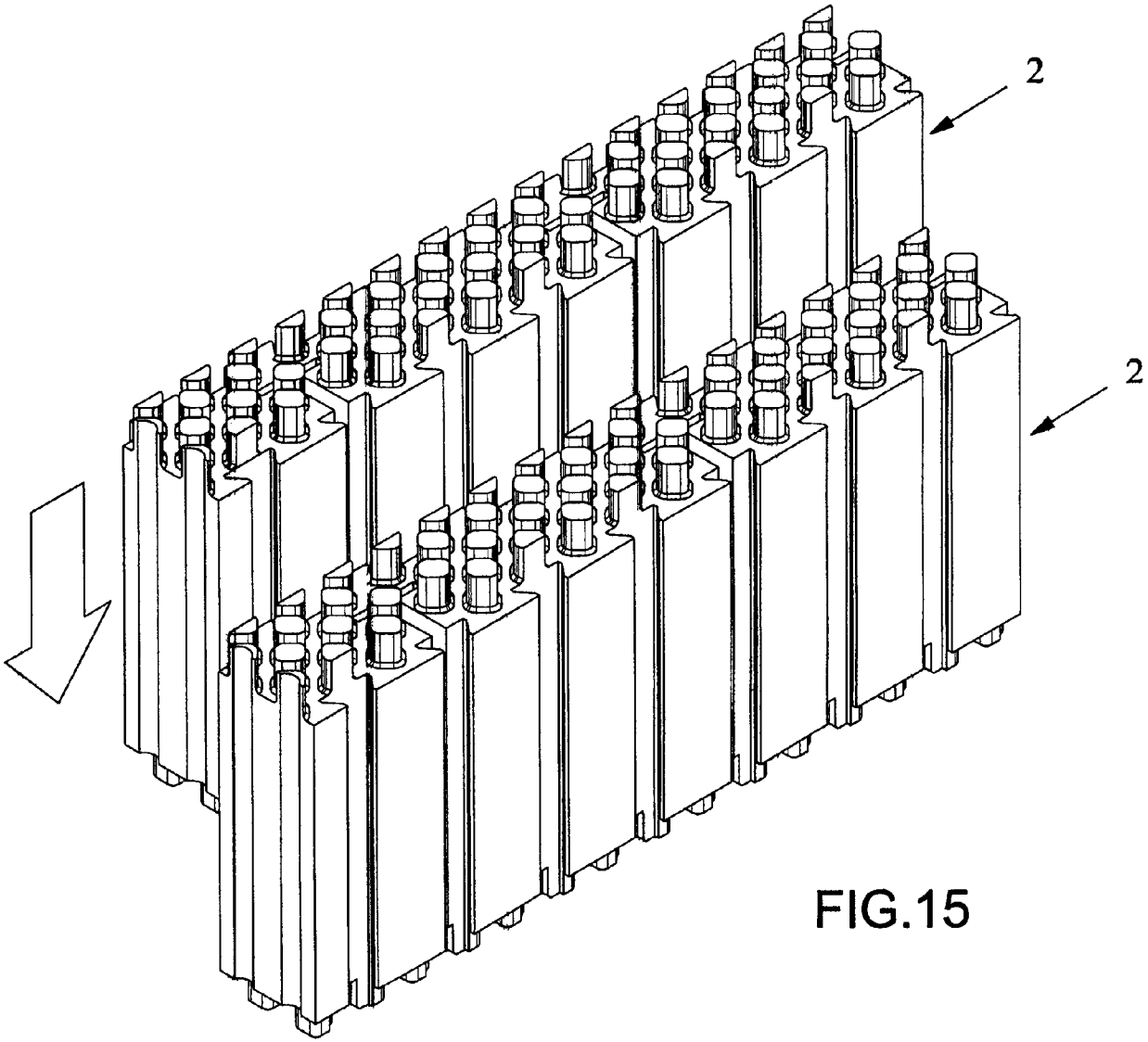
Figure 20:
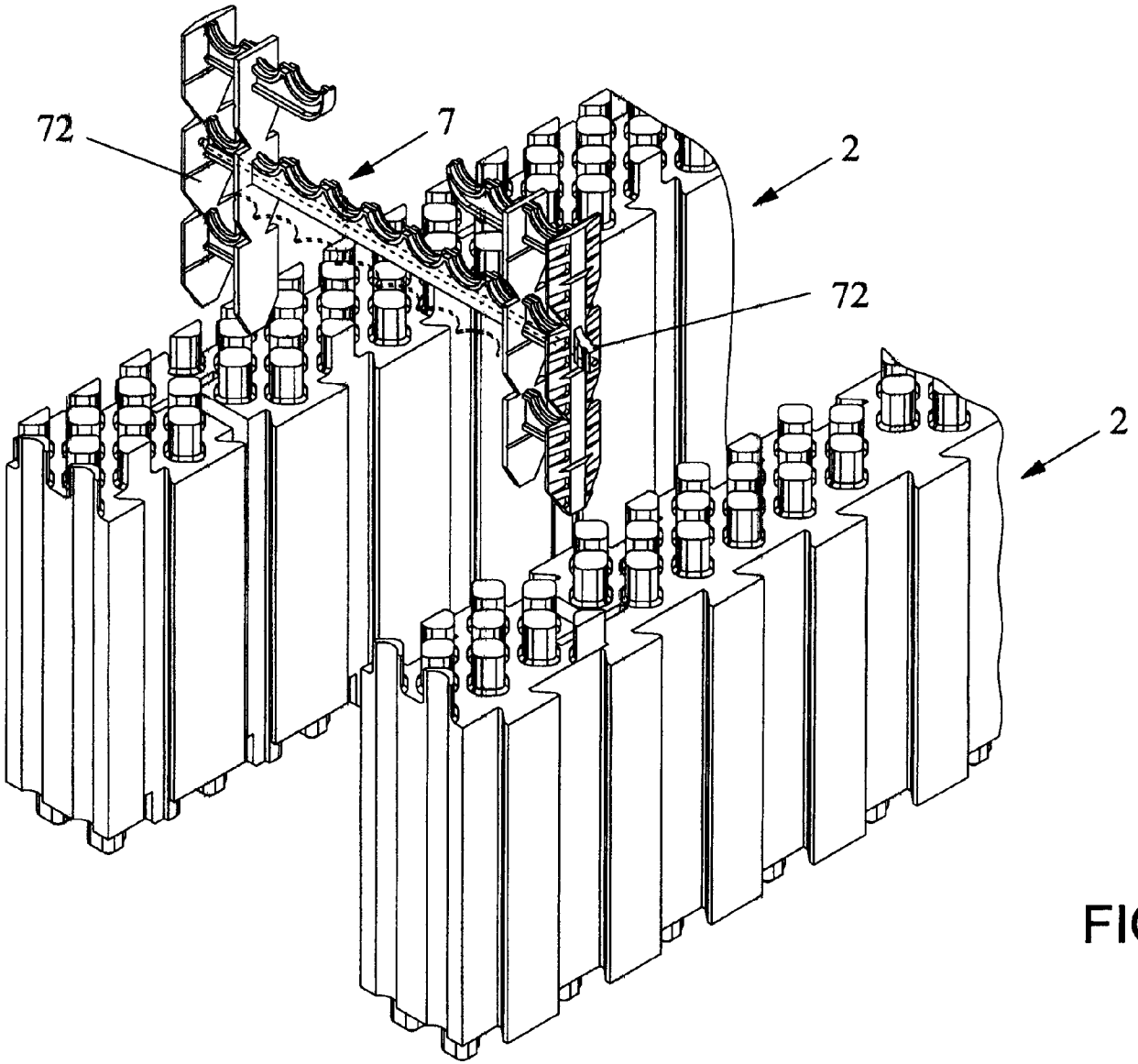
Figure 21:
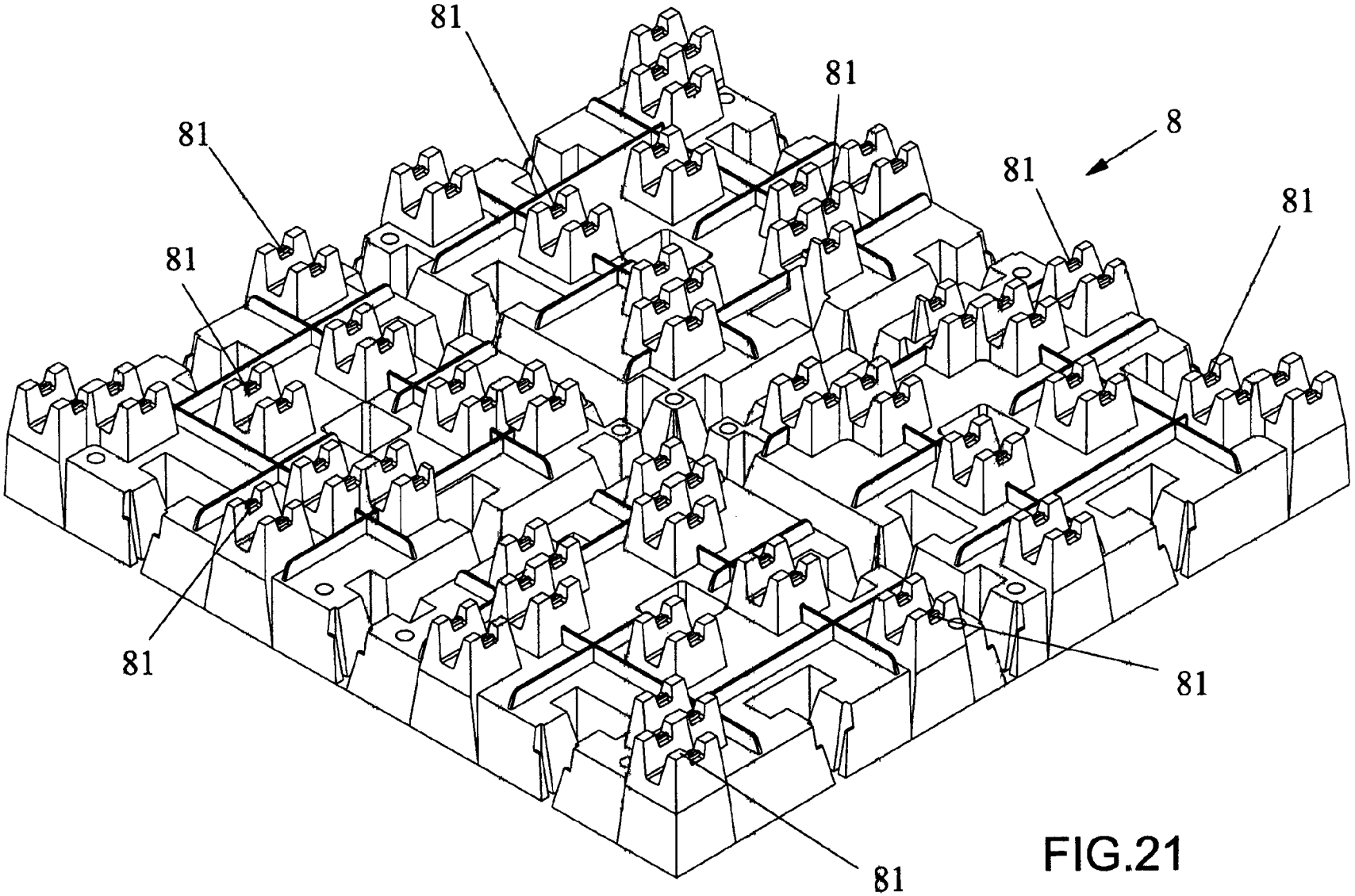
Figure 22:
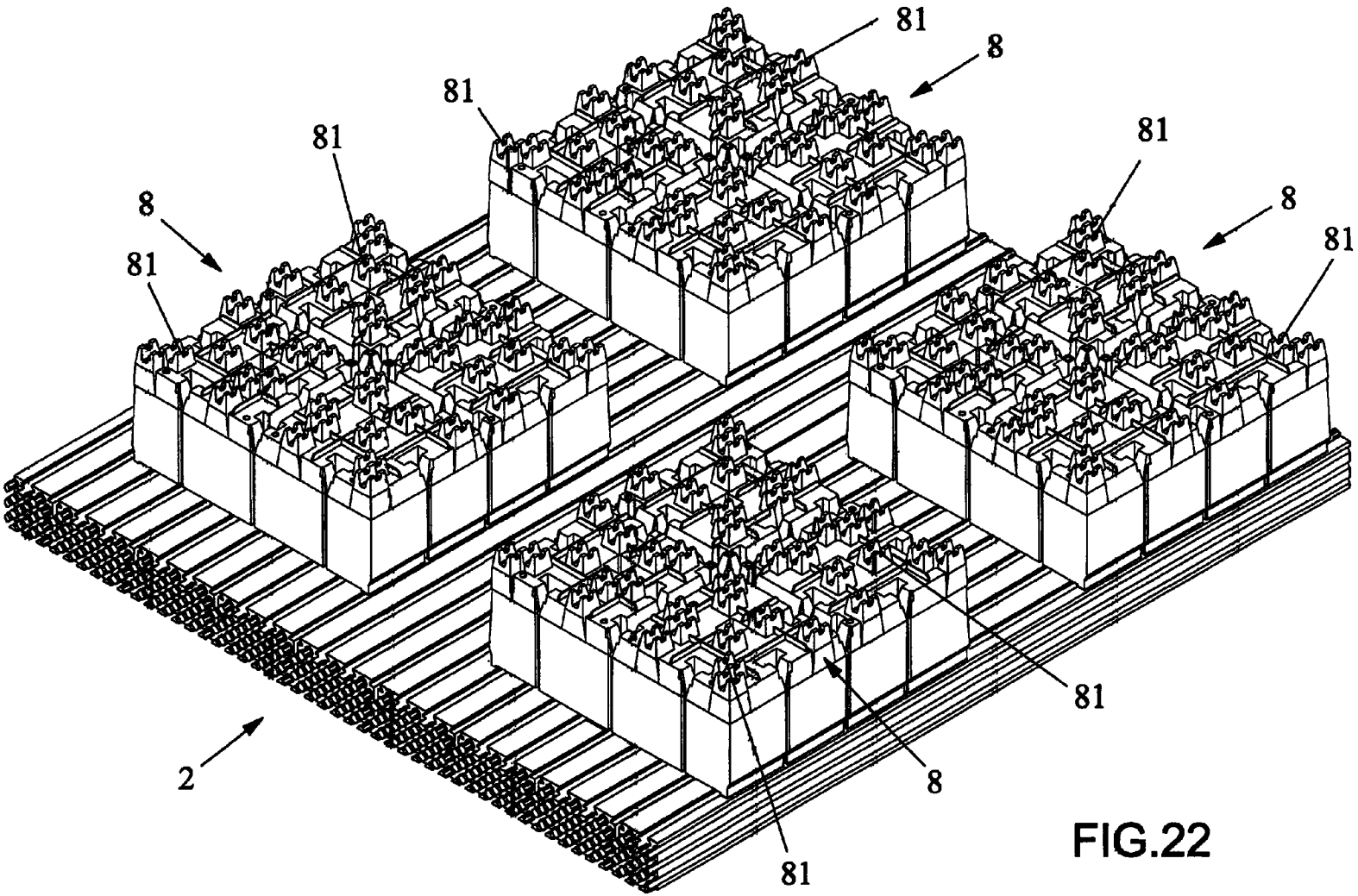
Figure 23:
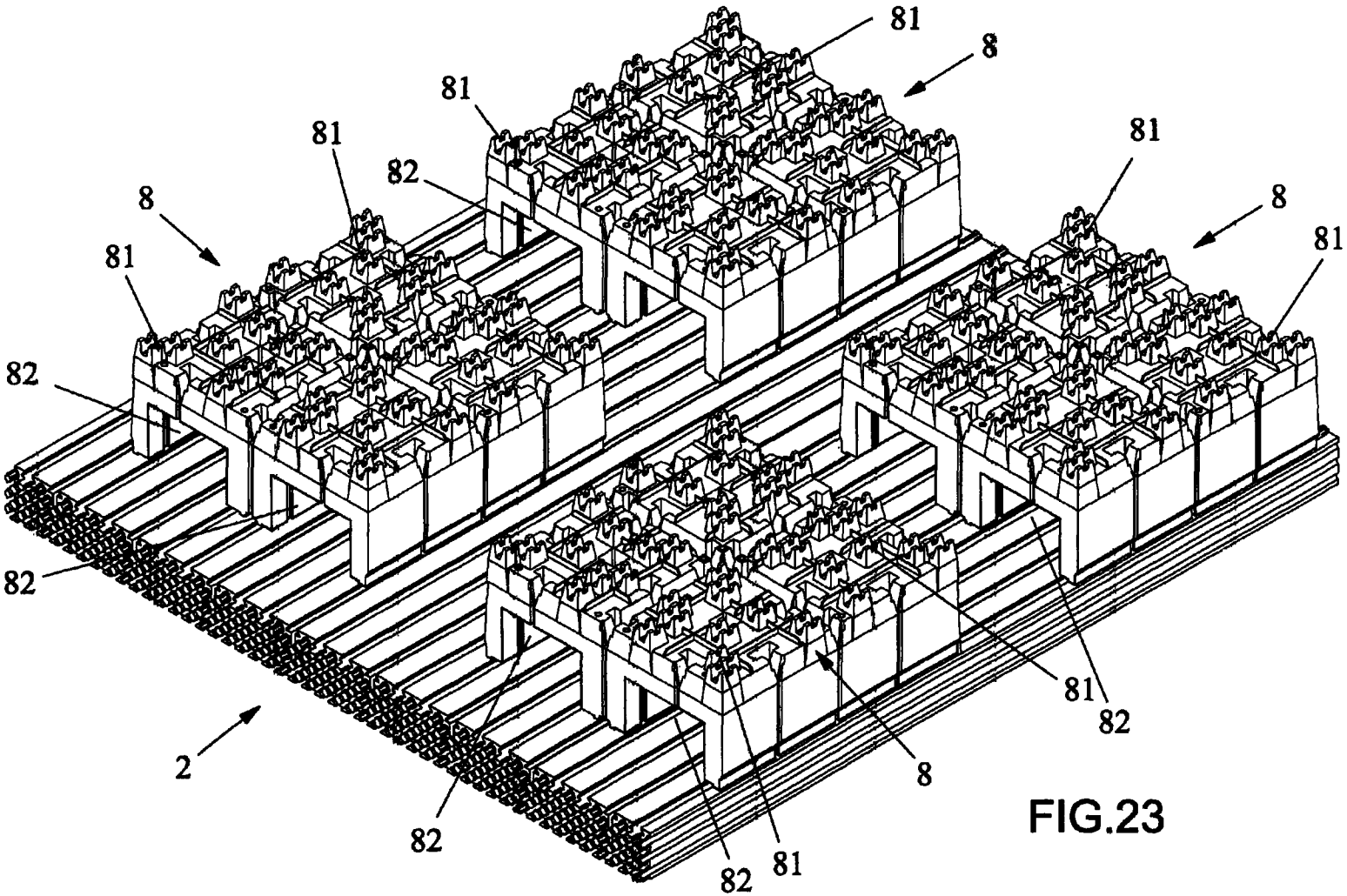
Figure 24:
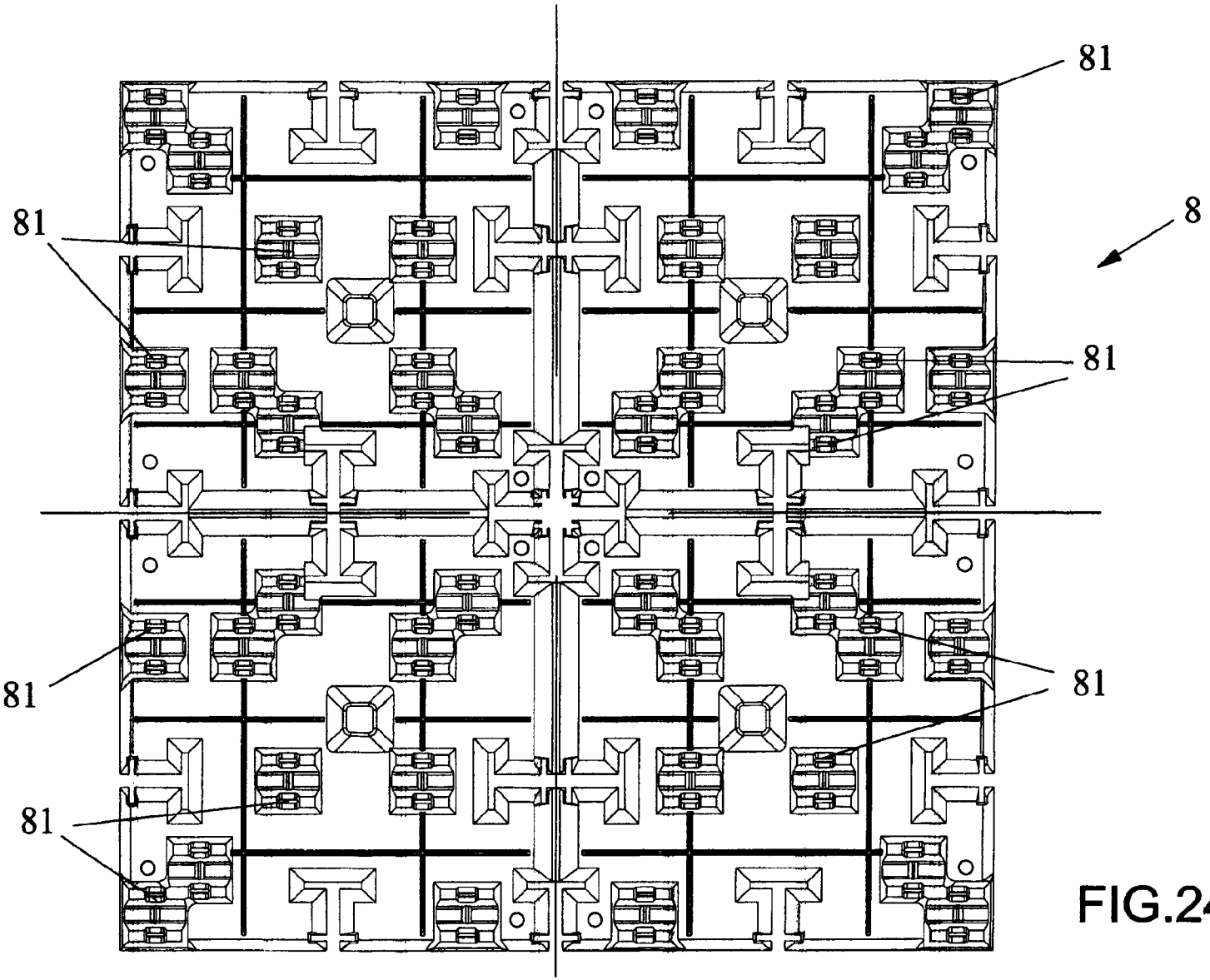
Figure 25:
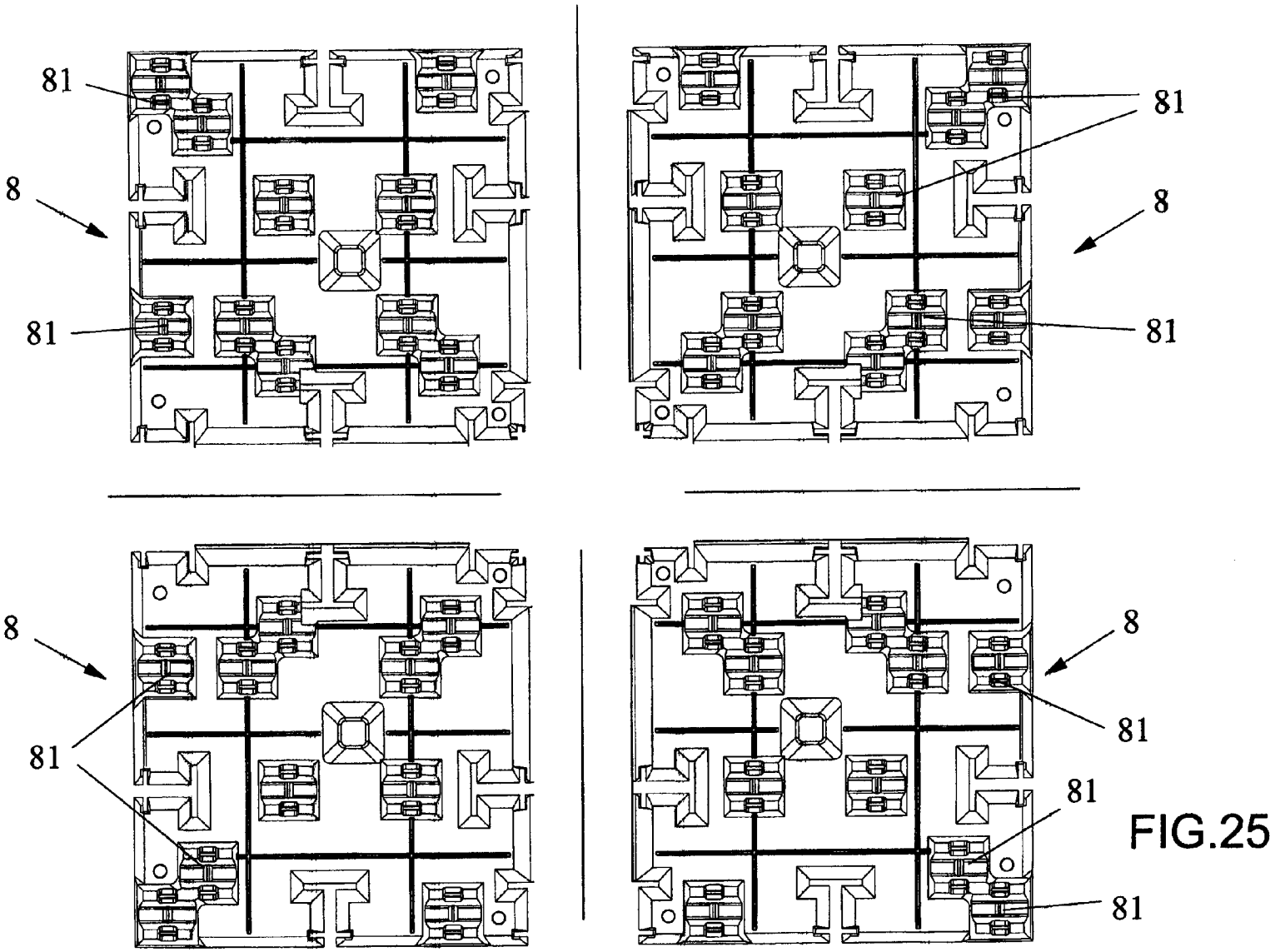
Figure 26:
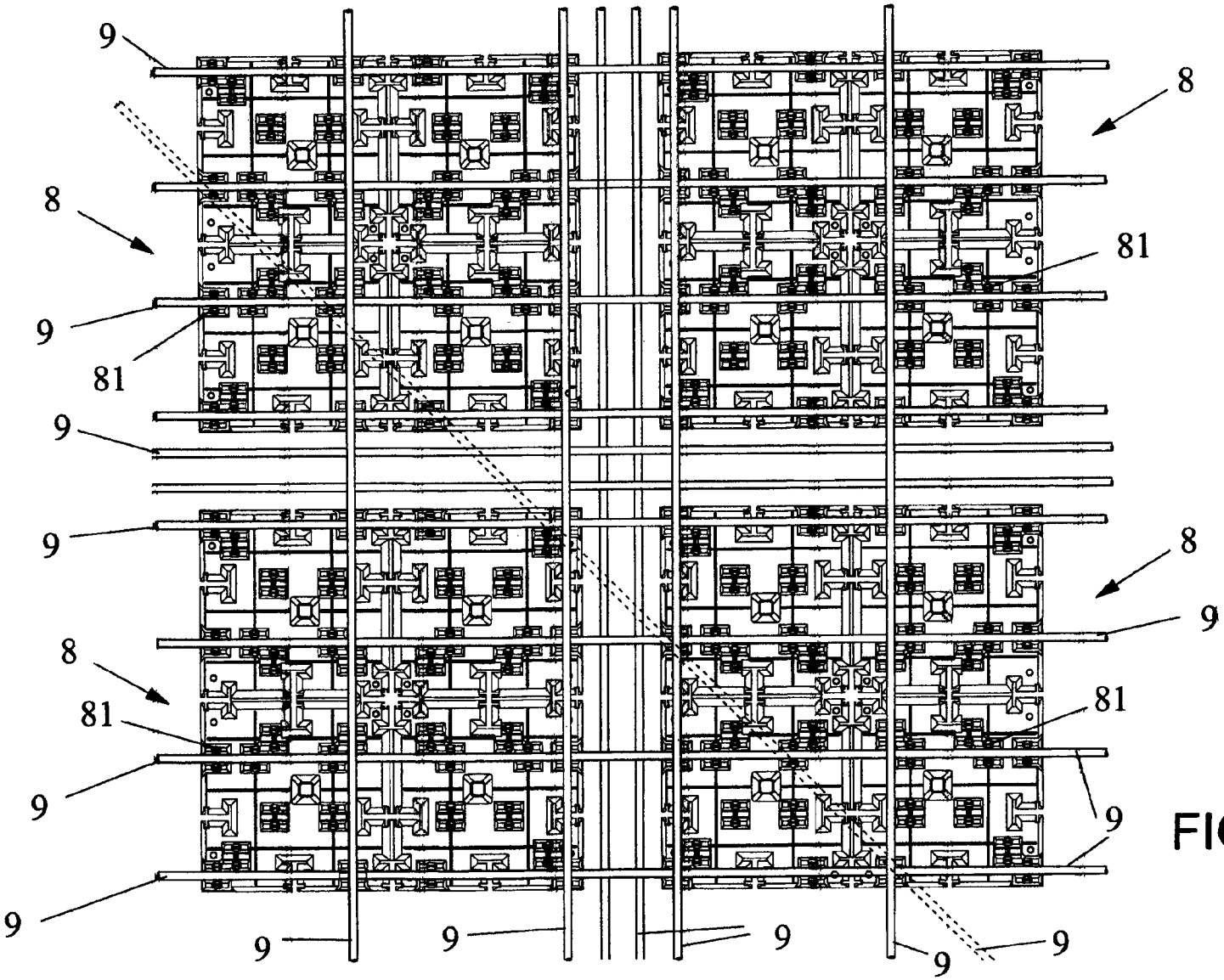
Figure 27:
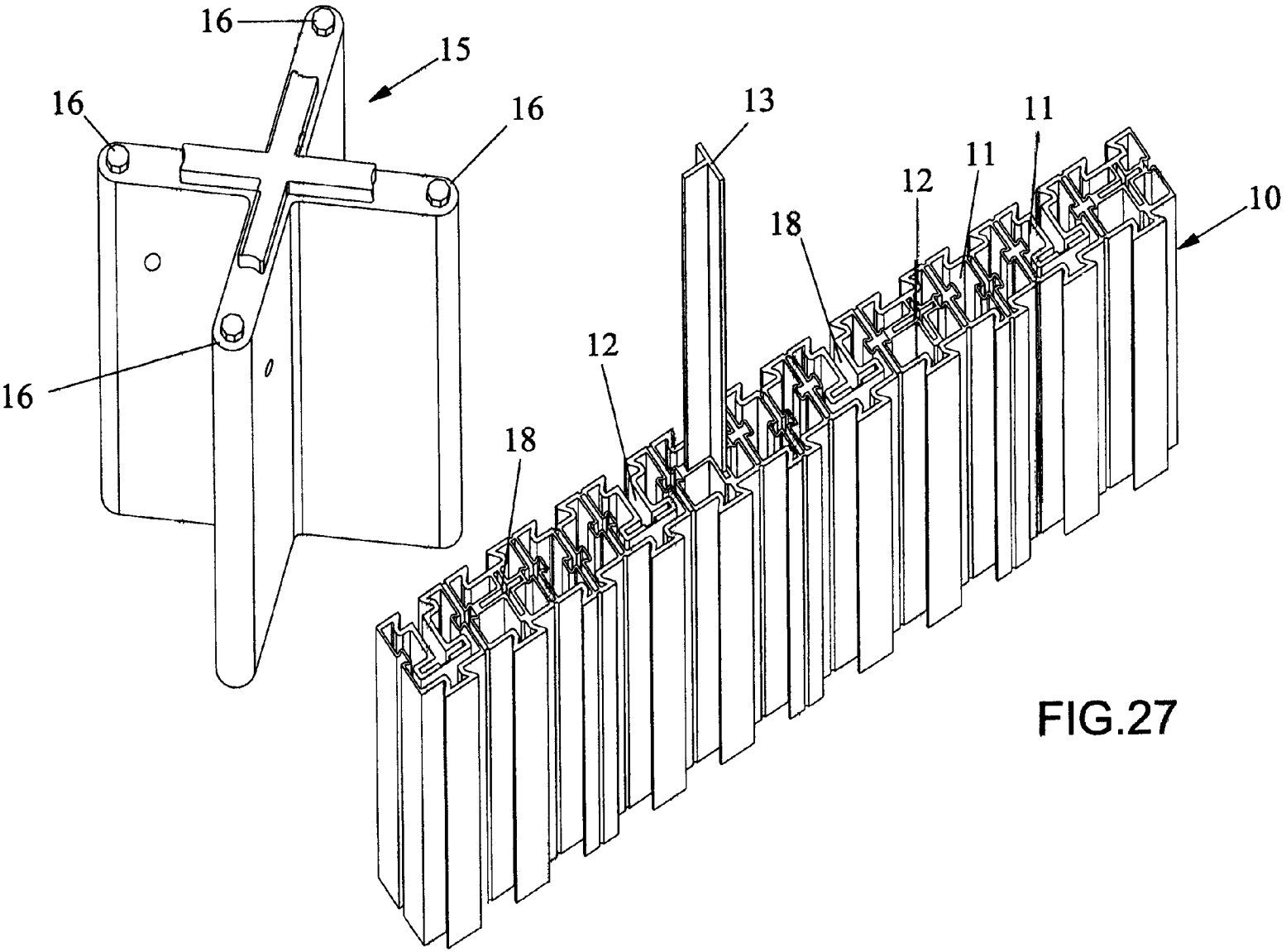
Figure 28:
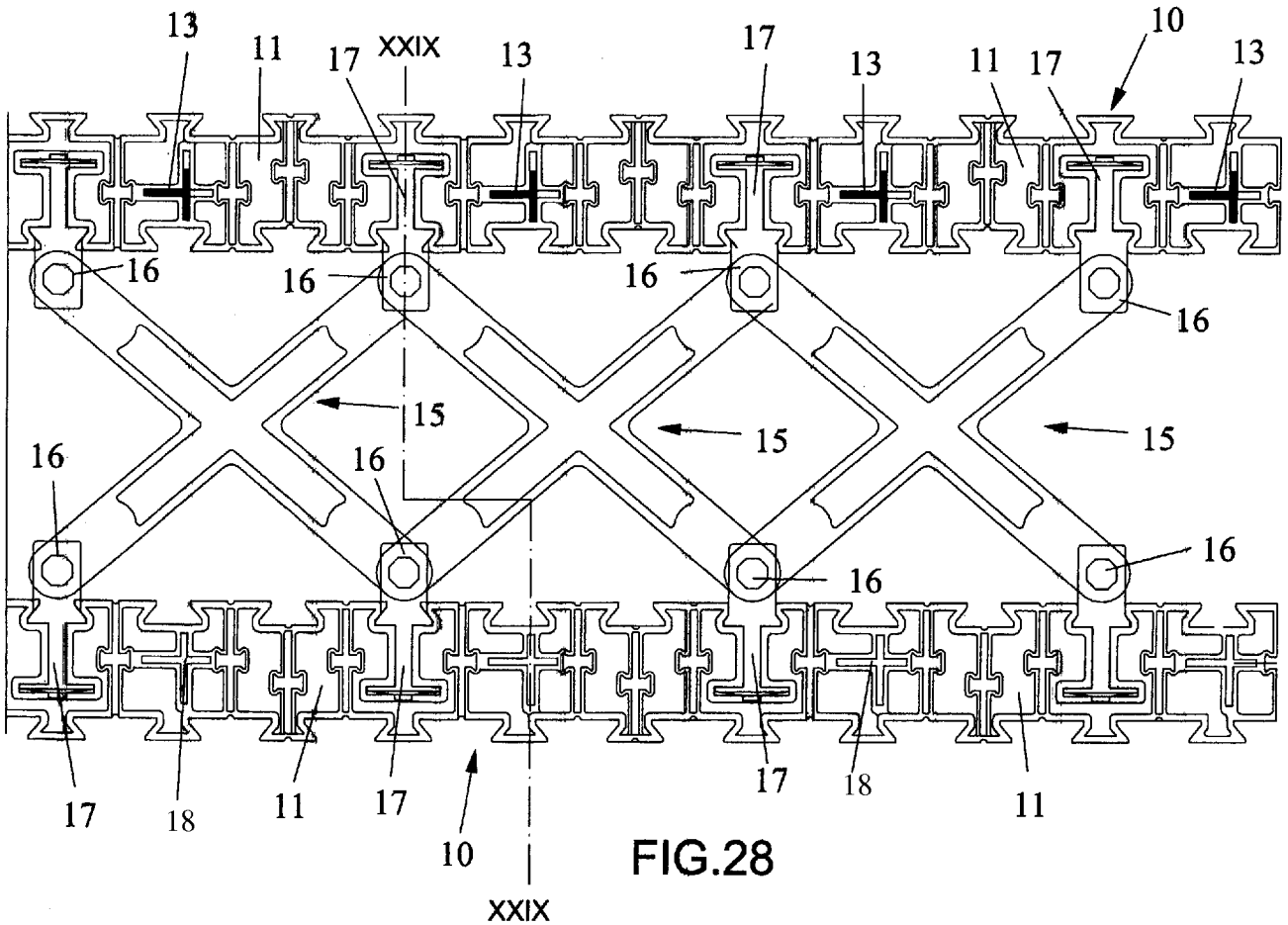
Figure 29:
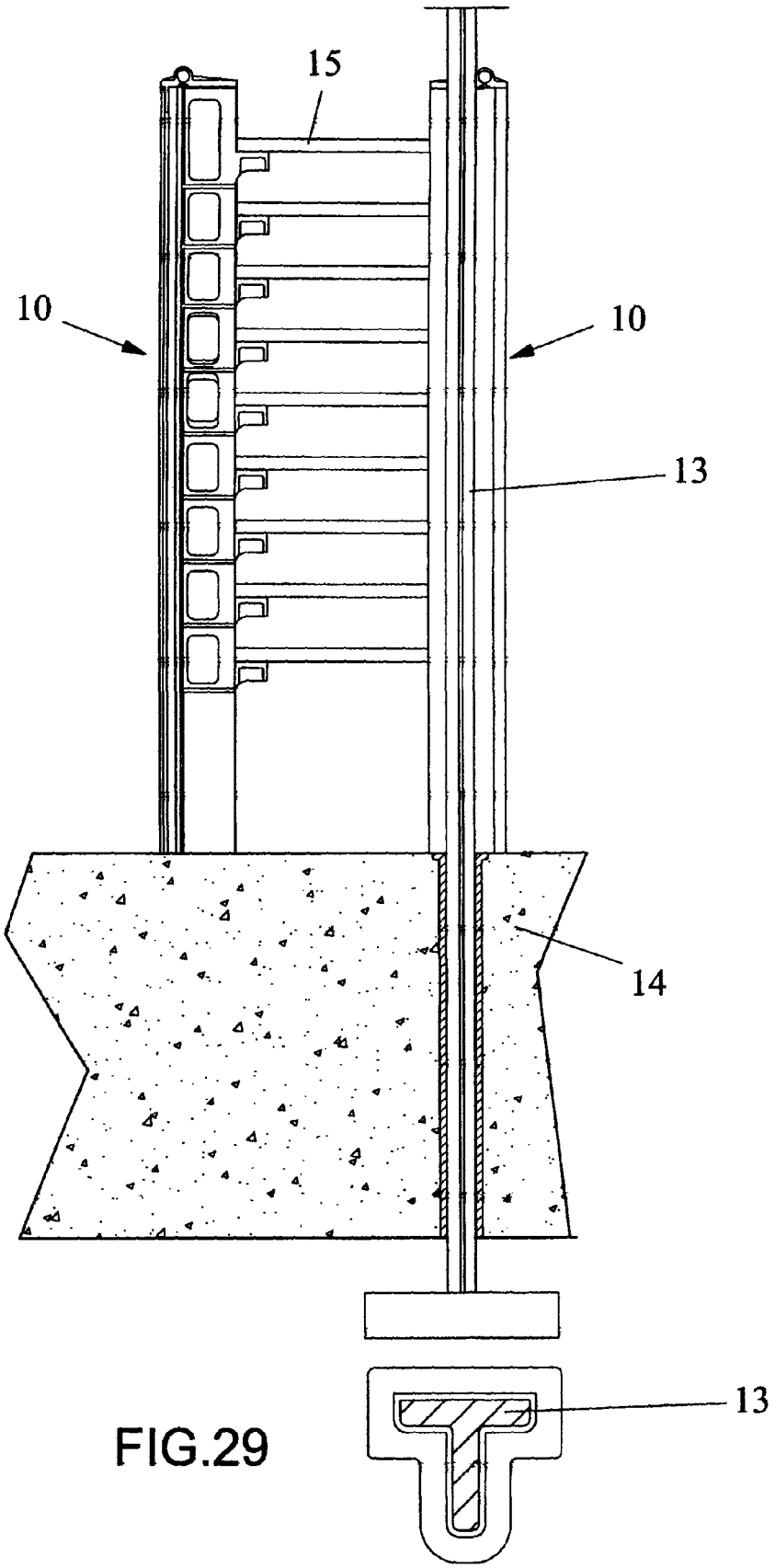
Figure 30:
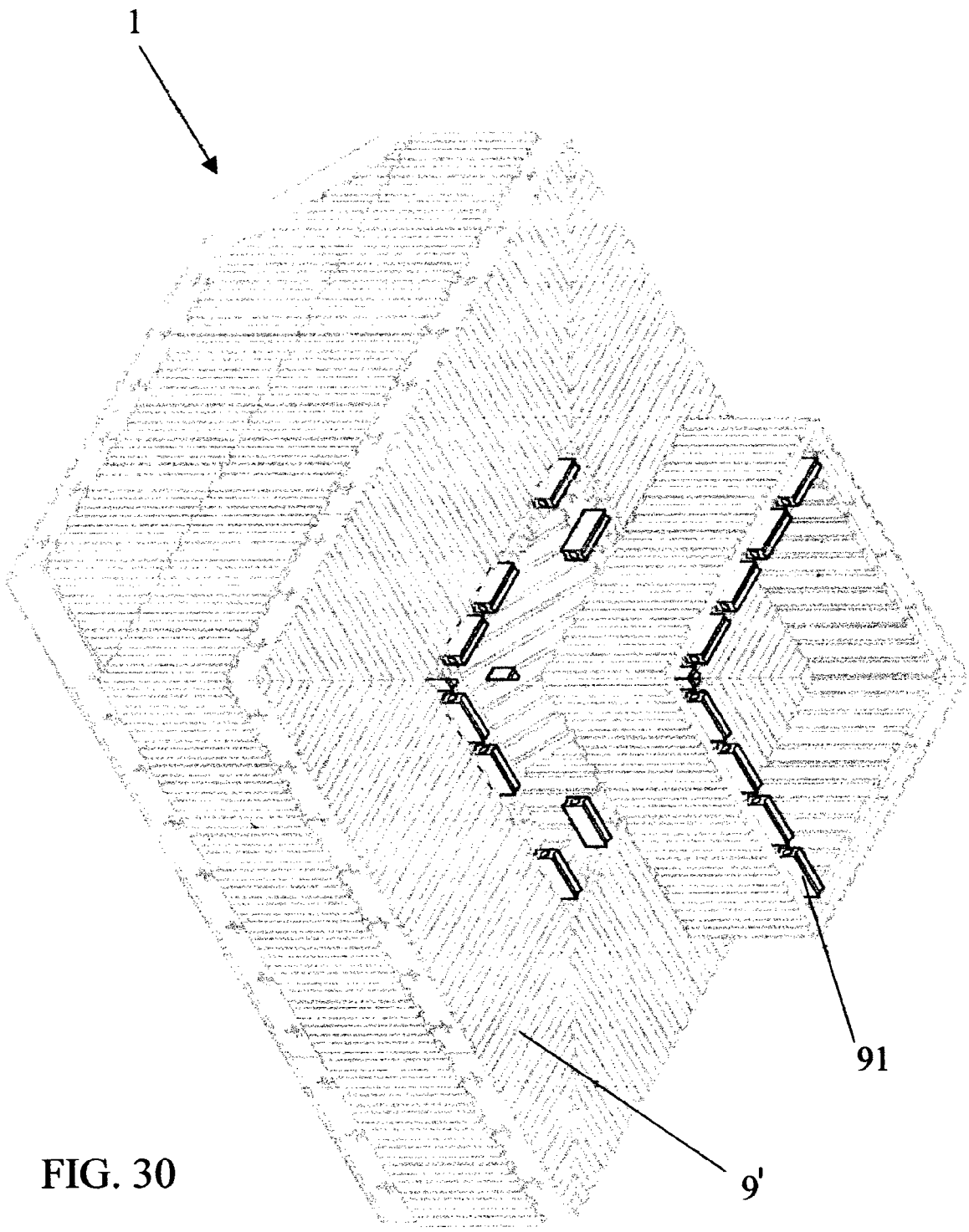

FIG. 11 is a sectional view that shows another embodiment of the structure (structural thermo-acoustic coat) composed of a modular element joined to a masonry wall through variable-geometry hollow spacers, with snap engagement, in which the part to with the spacers are fastened with snap-type device, namely the part between masonry and panel, can remain hollow for ventilation (ventilated thermo-acoustic coat) or be reinforced with steel bars placed both horizontally, and vertically, to then pour cement around them, in order to structurally reinforce a traditional wall in masonry or any type, and consequently make it thermo-acoustic;

FIG. 12 is a sectional view that shows another embodiment of the structure composed of a modular element with macro-aeration (ventilation) passages joined to a concrete wall or a traditional masonry;

FIG. 13 is a perspective view of the structure shown in FIG. 8;

FIG. 14 is a perspective view of the structure shown in the figure with a face panel at view without any limitation of drawing arrangement at view;

FIG. 15 is a perspective view that shows the system for joining two modular elements;

FIGS. 16-17-18-19 are perspective views that show various modes for joining the variable-geometry modular elements of the structure;

FIG. 20 is a perspective view that shows the system for joining two modular elements through variable-geometry spacers (connectors) with an integrated micro-valve for expelling saturated steam;

FIG. 21 is a perspective view that shows a basic element for mono-directional and reticular floors, in which it is possible to house steel bars with multiple measures in a mono-directional and reticular sense in extrados in suitable cones, that allow guaranteeing an adequate iron-covering element for all standards, even the most restrictive ones;

FIG. 22 is a perspective view that shows a portion or reticular floor composed of basic elements abutted onto a modular element (modular pot made of polystyrene with variable height with precuts—that can be divided by half and one fourth—with an always modular arrangement of recesses placed longitudinally thereto, for inserting therein variable-geometry reinforcement-carrying modular connectors;

FIG. 23 is a perspective view that shows a portion of a modular, variable-geometry and reticular floor, composed of basic elements, with sanitary and electric plant passages (pot made of polystyrene with internally recessed seats in which the closing plug is placed with a recess placed in its center, in which the reinforcement-carrying connector is placed, modular in height and width) for housing aeration, abutted onto a modular element;

FIG. 24 is a plan view of a basic element for mono-directional and bidirectional variable-geometry floor, comprising the tapered seats for housing the variable-geometry reinforcement-carrying modular connectors;

FIG. 25 is a plan view of a fourth (a basic element made of polypropylene and a basic element with thermo-reflecting aluminium sheet in extrados) of the structure shown in FIG. 23;

FIG. 26 is a plan view of the structure, similar to the previous one, but with the addition of reinforcing irons placed in a reticular way at 90° and 45°, with variable geometry and in multiples, of the mono-directional and bidirectional floor and completed with transpiring system;

FIG. 27 is a perspective view that shows a variable-geometry modular element open in its lower and upper surfaces and a cross-type spacer element;

FIG. 28 is a plan view that shows the system for joining two variable-geometry modular elements through the cross-type spacer element of the previous figure;

FIG. 29 is a sectional view made along the sectional plane XXIX-XXIX of FIG. 28.

With particular reference to the numeric symbols of the above figures, the variable-geometry modular structure according to the invention, globally designated by reference number 1, comprises a variable-geometry modular element 2, with a honey-comb structure, also modular with variable geometry, equipped with precuts next to the fastening dove-tails for other elements, subjected to be joined to different modular components to obtain several embodiments, according to needs.

The variable-geometry modular element 2 is advantageously made of plastic material and has a series of passages and recesses 21 in which vacuum is created when manufacturing, by molding or extrusion, the modular element.

The variable-geometry modular element 2 therefore is a structural element and has at the same time exclusive insulating, thermal and acoustic characteristics.

The internal surfaces of the modular element have a series of recesses 22 and ribs 23, shaped as a dove-tail, that allow mutually join two or more elements in order to increase the structure thickness, as shown in FIG. 15.

The variable-geometry modular elements 2 can further be butt-joined, using the modular male and female posts 24 arranged next to the passages 21.

Figure 1:
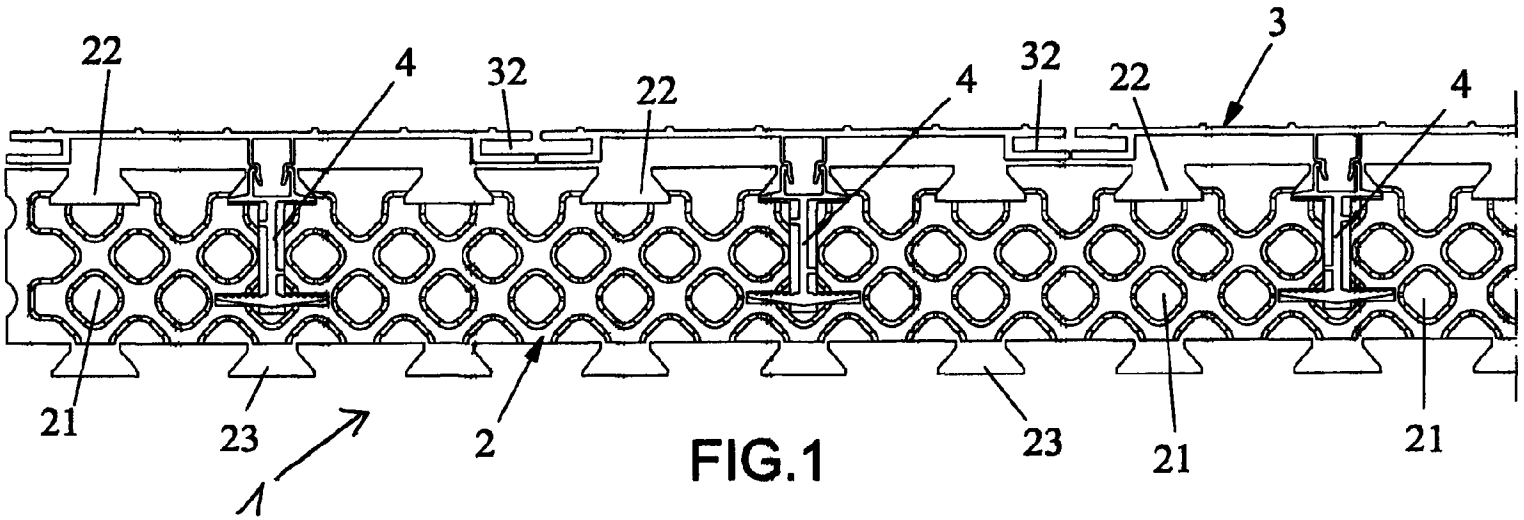
FIG. 1 is a sectional view that shows a basic embodiment of the structure composed of a modular element joined to a variable-geometry panel made of a metallic or plastic alloy.
Figure 2:
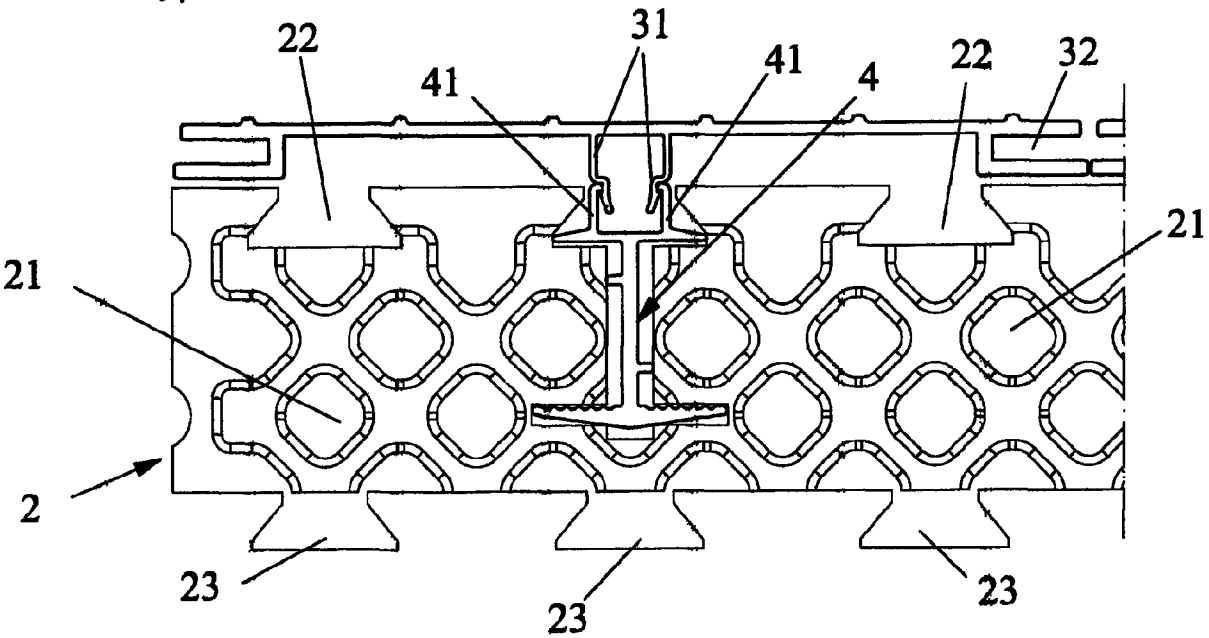
FIG. 2 is a sectional view of the same modular structure, enlarged with respect to the previous figure.

FIGS. 1 and 2 show a first embodiment composed of the variable-geometry modular element 2 joined to a panel 3, also with variable geometry, which has a substantially smooth external surface, with small modular ribs, and adapted to be mounted at view.

The panel 3 is fastened to the variable-geometry modular element 2 through suitable brackets or double-T shaped profiles, designated by reference number 4, which are inserted into suitable slits provided in the modular element itself.

The brackets 4 has a portion with elastic teeth capable of snapping locking the corresponding connection edges 31 provided on the internal side of the panel 3.

Figure 3:
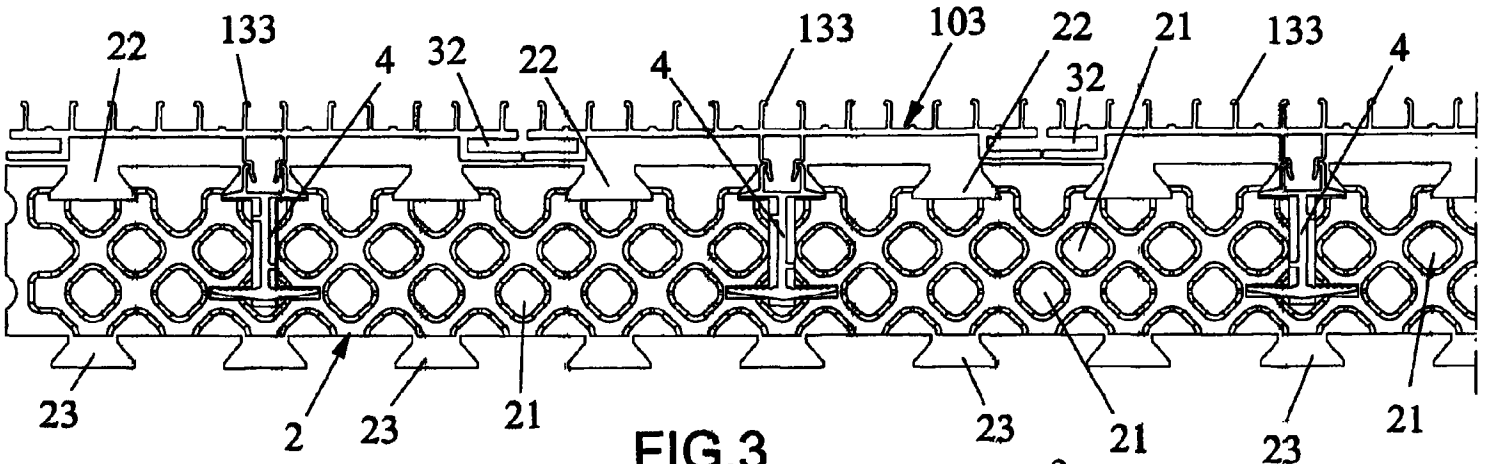
FIG. 3 is a sectional view that shows another basic embodiment of the structure composed of a variable-geometry modular element made of a metallic or plastic alloy joined to another type of panel.

FIG. 3 shows an embodiment that is substantially similar to the previous one, apart from that the panel, designated with reference number 103, has a corrugated external surface 133, which is used for applying a plaster, even a traditional one, or other finishing elements without any limit.

Figure 4:
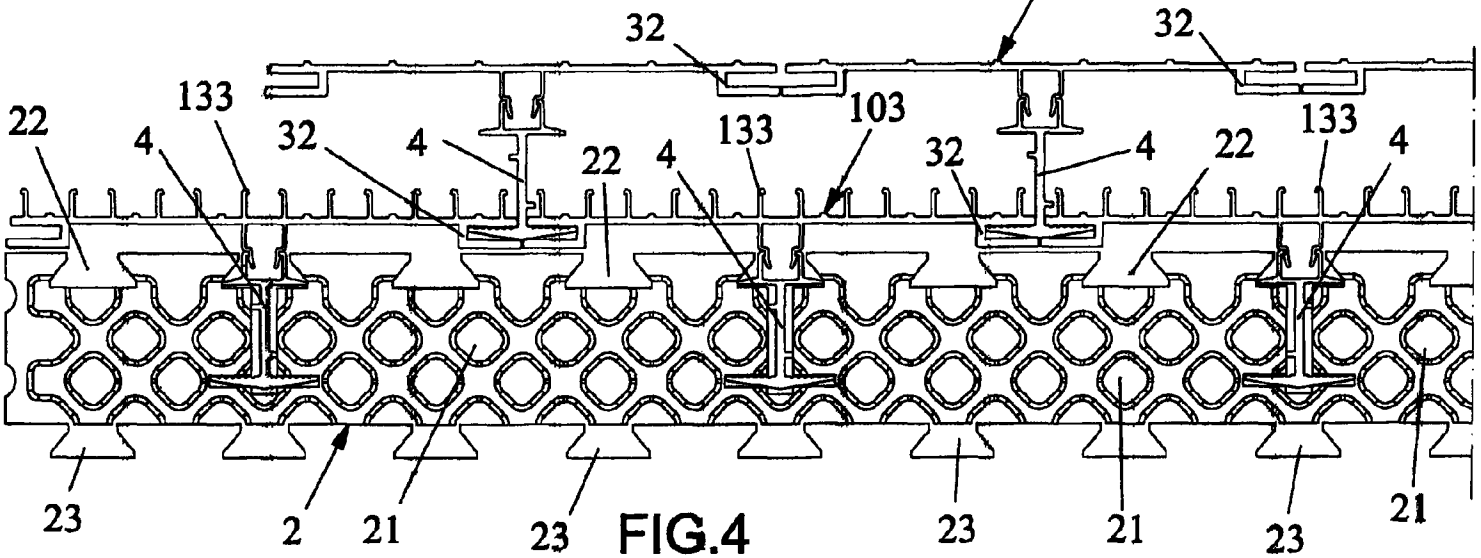
FIG. 4 is a sectional view that shows another embodiment of the structure composed of a variable-geometry modular element joined to two types of panels with snap-type devices made of a metallic or plastic alloy.

FIG. 4 shows an embodiment composed by joining two panels 3 and 103 to a modular element 2.

The panels are mutually joined through the same brackets 4 that can be inserted in suitable longitudinal slits 32, provided on the panels 3 and 103.

Figure 5:
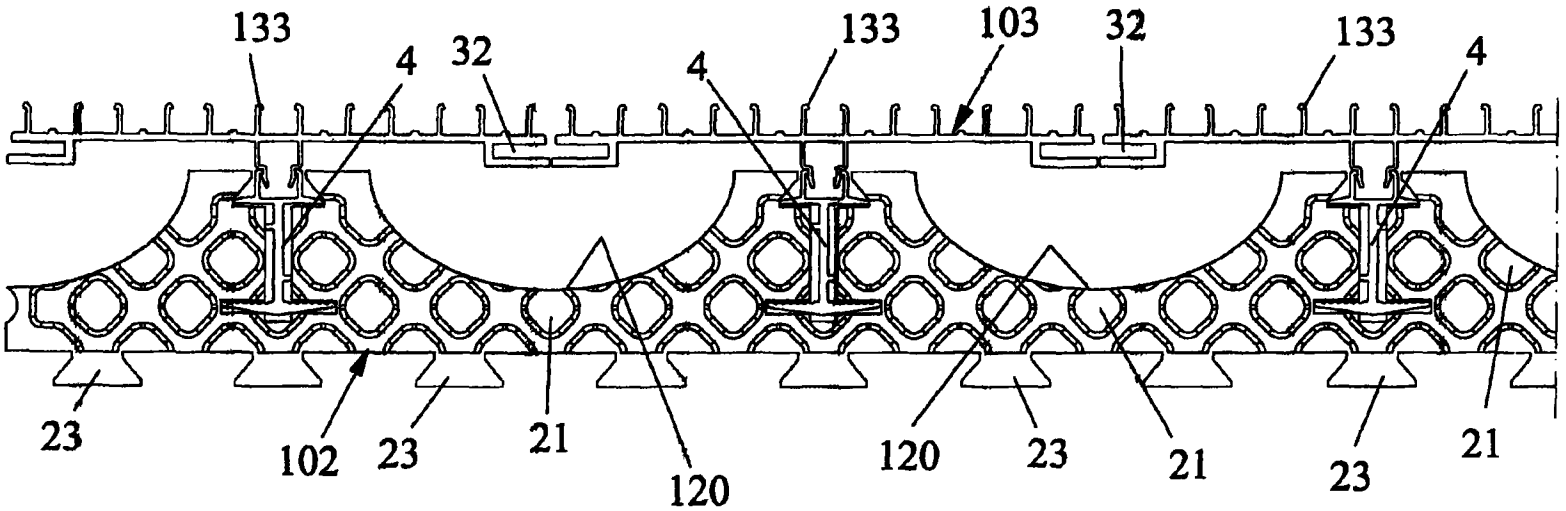
FIG. 5 is a sectional vie that shows another embodiment of the structure composed of a further type of variable-geometry modular element joined to a panel in which modular recesses are placed, shaped as a half-circle or any other shape, longitudinally placed with respect thereto, so that air circulation is allowed and made easier, due to its smooth surface free from obstacles.
Figure 6:
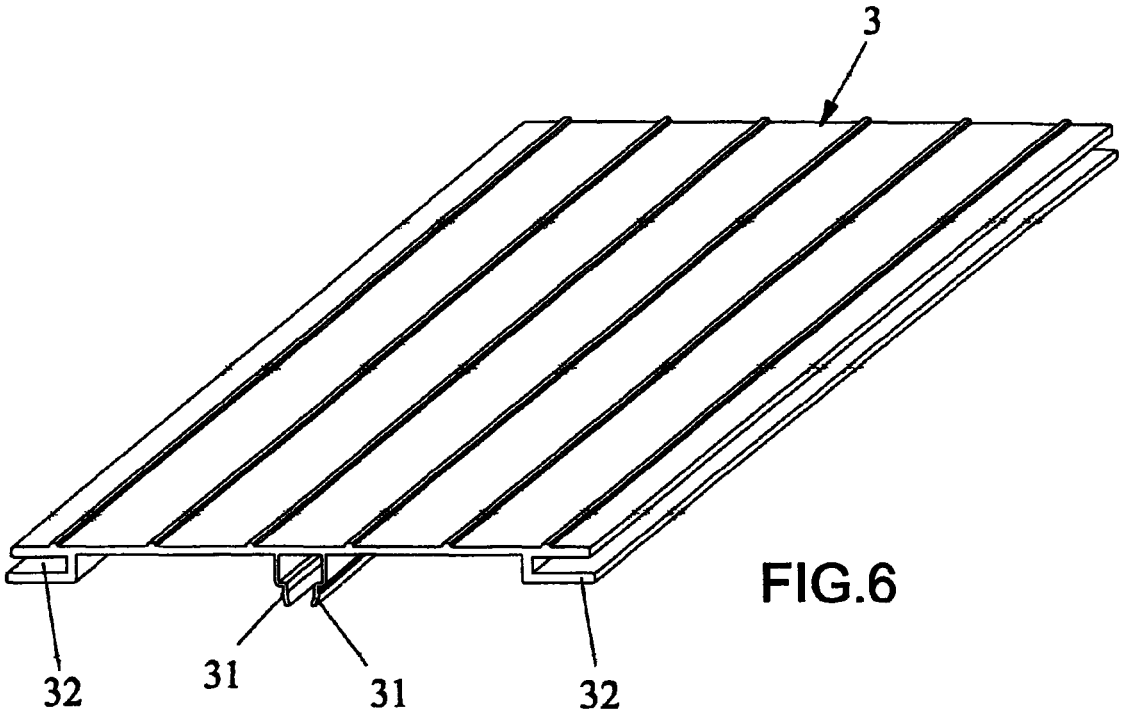
FIG. 6 is a perspective view of a type of variable-geometry panel made of a metallic alloy or plastics with a ribbed or smooth surface in extrados and with intrados snap-type engaging clips.
Figure 7:
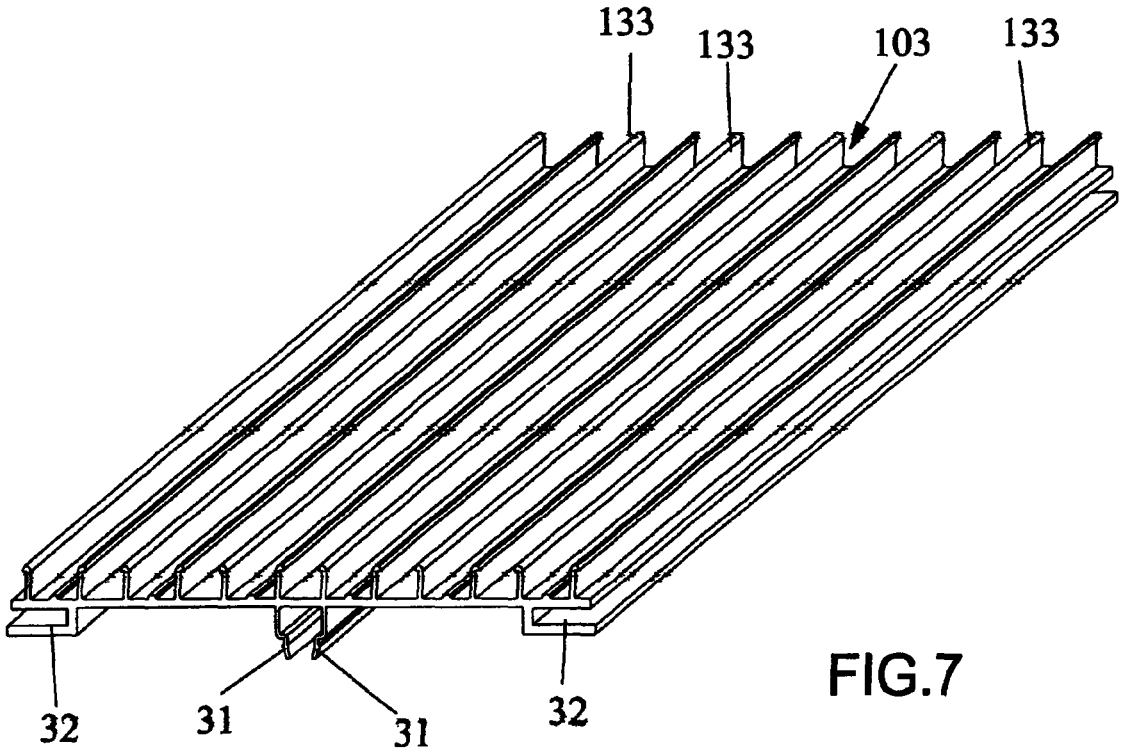
FIG. 7 is a perspective view of a type of variable-geometry panel with snap-type devices made of a metallic or plastic alloy with modular corrugated surface.

FIG. 5 shows an embodiment composed of a variable-geometry modular element 102 conceptually similar to the previously-described modular element 2, also with variable geometry, but equipped with wide flaring 120 in order to enable aeration and expulsion of saturated steam outside the masonry.

Also the modular element 102 has suitable slits to house the connecting brackets 4 for fastening, for example, the corrugated panel 103.

Figure 9:
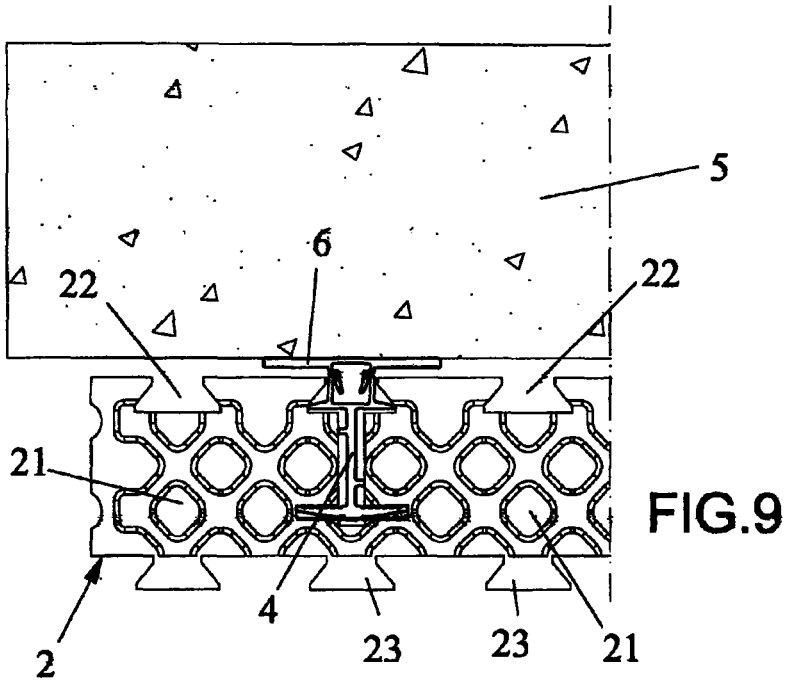
FIG. 9 is a sectional view of the same structure, enlarged with respect to the previous figure.

FIG. 8 shows an embodiment composed of a variable-geometry modular element 2 fastened to a masonry wall through the brackets 4 and fastening section bars 6, secured to the wall itself, as can be netter seen in FIG. 9.

In such embodiment, the structure is advantageously used to make a so-called "thermo-acoustic coat", "ventilated thermo-acoustic coat", "thermo-acoustic coat for structural reinforcement", "thermo-reflecting coat", on an already existing building.

Figure 10:
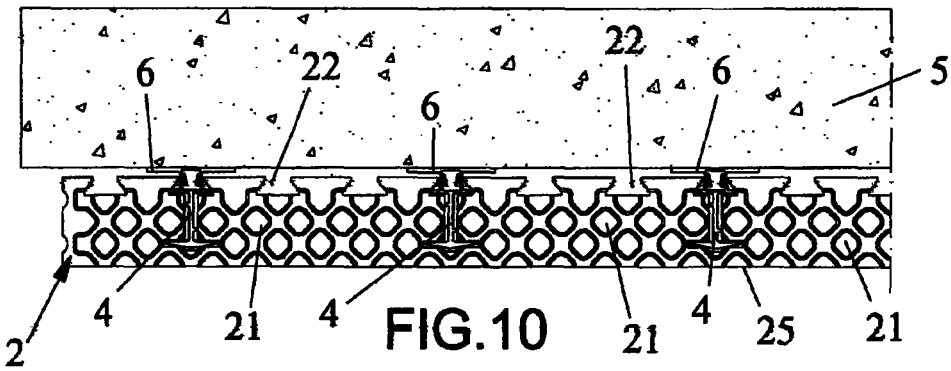
FIG. 10 is a sectional view that shows another embodiment of the structure composed of another type of modular element joined to a concrete wall or a traditional masonry.

FIG. 10 shows an embodiment with a variable-geometry modular element 2 modified in order to have an external surface 25, in which the external surface is already finished with "face at view" without design limits, as can be also seen in FIG. 14.

Figure 16:
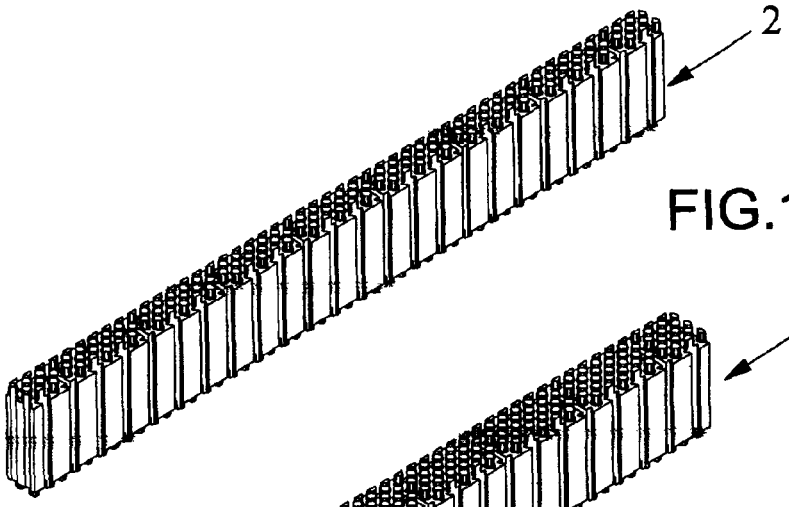
Figure 17:
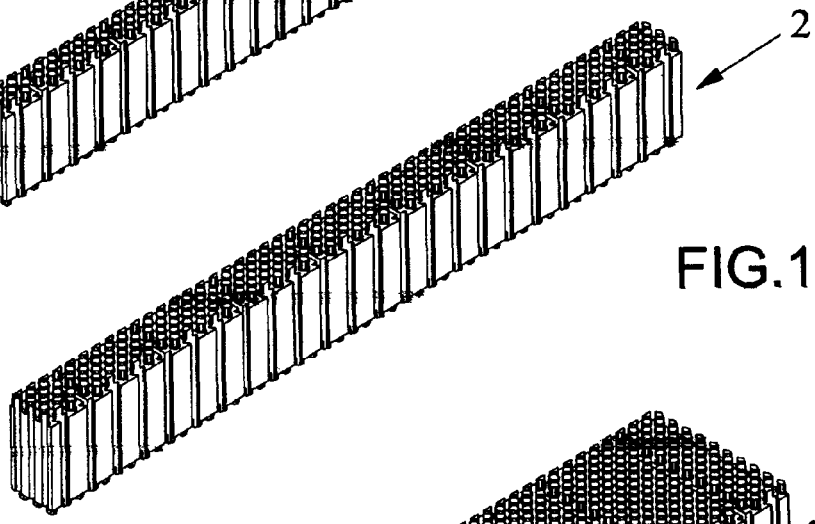
Figure 18:
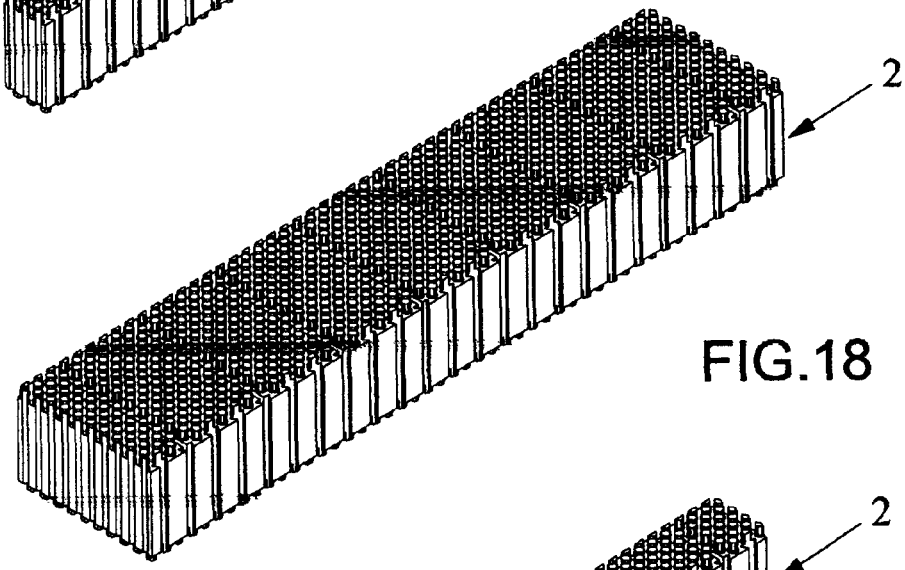
Figure 19:
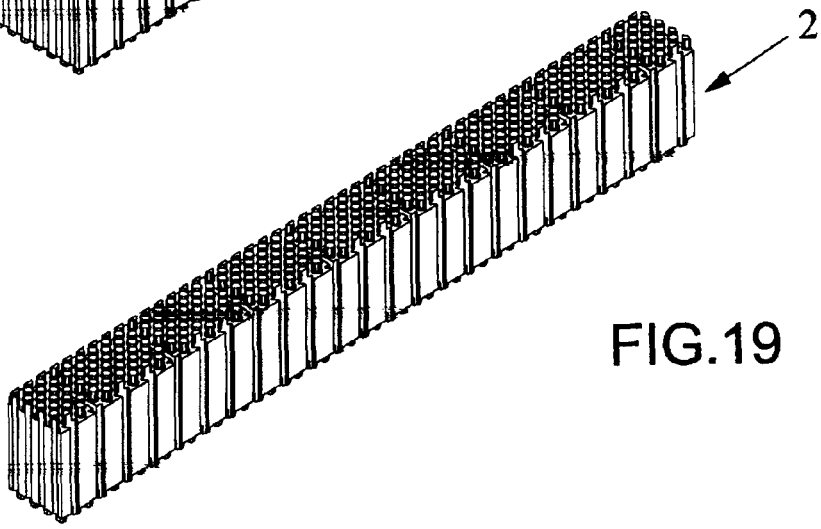

FIGS. 16-17 schematically show different ways for combining the variable-geometry modular elements 2 to make variable-geometry seism-resisting structures with different thickness, according to specific needs.

FIG. 20 shows an embodiment composed of a pair of variable-geometry modular elements 2 mutually joined through a series of spacers (variable-geometry connectors) 7 in multiples, without pitch limits, composed of cross-members 71 that have their ends fastened in modified brackets 72 suitable to be inserted into the slits provided in the variable-geometry modular elements for the above-described brackets 4.

The sizes of the cross-members (variable-geometry connectors) equipped with precuts for adjusting their height for positioning the reinforcement bars, completed with micro-valve 71 for aeration passage, can be adjusted in order to change the distance between the two modular elements; both the cross-members (variable-geometry connectors) 71, and the brackets 72 have suitable recesses to house various elements, also adjustable in multiples, such as rod irons, tubes, corrugated elements, cables, etc.

FIG. 21 shows a structure component composed of a variable-geometry basic element 8 suitable for assembling and building a mono-directional or bidirectional floor.

The basic element 8 is advantageously made of a foamed plastic material, for example polystyrene or polyethylene, and has a series of saddle-type elements 81, also with variable geometry, arranged along two directions, mutually at 90°, to allow placing various elongated elements, for example steel rod irons, placed in a reticular and mono-directional sense, depending on need and without any limit, or water piping, corrugated elements or cables, in which technologic plants of any type can be made pass.

FIG. 22 shows one of the several embodiments, that comprises a series of basic elements 8 abutted onto a variable-geometry modular element 2 and mutually spaced in multiples, in order to define recesses or ribs in which reinforcing irons can be inserted, or other steel elements 9 like IPE-INP-UNP, of different types and shapes (even the most varied ones), and in which concrete is cast in order to form small structural cross-members.

The sizes of the small cross-members are several, without height and width limits for the ribs, and are delimited by the above variable-geometry basic modular elements 8, that are elements adapted to operate as caisson, upon casting the concrete or other composite materials, also structurally and thermo-acoustically compliant.

The variable-geometry basic elements 8 shown in FIG. 23 have aeration passages 82.

The aeration passages 82 and the upper part of each basic element 8 have a tapered modular shape that allows stacking many variable-geometry modular elements 8, without further encumbrances, since the upper part of the basic element 8 is inserted into the aeration passage 82 of the basic element 8 arranged thereover.

FIGS. 27-29 show an embodiment composed of a profiled modular element 10 made of plastic material through extrusion in order to form a series of longitudinal passages 11.

The variable-geometry profiled modular element 10 further has a series of cross-shaped passages 12, adapted to house respective T- or double-T-shaped bars (structural IPE), designated with reference number 13.

The T- or double-T-shaped bars (structural T-IPE) 13 have their bases fastened to the foundation (modular bracket for connecting the vertical bars) 14 and ensure stability of profiled modular elements 10.

Two or more profiled modular elements 13 can be mutually connected by means of cross-shaped brackets 15, which have four ends 16 hinged to fastening brackets 17 inserted into suitable securing slits 18.

It has been found in practice that the invention wholly obtains its pre-fixed task and objects. In fact, a variable-geometry modular structure has been made, for seism-resisting monolithic walls, variable-geometry monodirectional thermo-acoustic roofs and floors, variable-geometry bidirectional roofs and floors, thermo-acoustic coats, thermo-acoustic coats with longitudinal and reticular baffles made of structural concrete for reinforcing existing building structures, ventilated thermo-acoustic coats, ventilated thermo-acoustic roofs with extrados surfaces made of metallic alloys, thermo-reflecting and thermo-acoustic floors with extrados surfaces made of aluminium films, with exclusive transpiring and thermal and acoustic insulation characteristics.

The invention allows building a whole seism-resisting, transpiring and homogeneous structure in the devices composing it, due to the presence of modular elements equipped with recesses and air passages.

The variable-geometry modular elements of the structure can be used for making several types of caissons, for casting concrete or other composite materials complying at structural level, that are then an integral part of the finished building.

Obviously, the used materials, in addition to the sizes, could be of any type (even the most various ones), according to needs.

The invention claimed is:

1. A modular structure, particularly for buildings, comprising:

at least two modular elements, each modular element being equipped with a honey-comb structure and being made in plastic material and having a series of hollow posts defining passages therein, each modular element being a structural element and having insulating thermo-acoustic properties, a face of each modular element defining a series of alternating recesses and ribs, wherein said modular elements are mutually joined through a series of brackets to form a caisson, wherein the brackets each include first and second opposingly joined bracket members, the first bracket member disposed in a slot defined in one of the modular elements, the second bracket member disposed in one of the recesses in one of the modular elements.

2. The modular structure according to claim 1, wherein at least one modular element is adapted to be joined to a single panel, which has a substantially smooth external surface adapted to be assembled at view or a corrugated external surface, which is used for applying plaster or other finishing elements.

3. The modular structure according to claim 2, wherein the panel is fastened to the modular element through T-shaped or double-T-shaped brackets, which are inserted into the slot, said brackets having a portion with elastic teeth capable of snappingly blocking corresponding connection edges provided on an internal side of the panel.

4. The modular structure according to claim 2, further comprising two panels joined to the modular structure, said panels being mutually joined through the same brackets that are inserted in suitable longitudinal slits slots provided on the panels.

5. The modular structure according to claim 1, further comprising a modular element equipped with wide flaring to favour its aeration.

6. The modular structure according to claim 1, wherein the modular element is fastened to a masonry wall through brackets and through fastening section bars secured onto the wall.

7. The modular structure according to claim 1, wherein at least one of the brackets includes spacers composed of cross-members, that have their ends fastened to the bracket members, adapted to be inserted into the corresponding slot provided in the modular elements for double-T-INP-UNP brackets, the sizes of the cross-members being adjustable to change the distance between the two modular elements, both the cross-members and the bracket members having suitable recesses to house different elements.

8. The modular structure according to claim 1, further comprising a basic element adapted to build a mono-directional or bidirectional floor.

9. The modular structure according to claim 8, wherein the said basic element is made of foamed plastic material, and having a series of tapered saddle-type elements arranged along two directions, mutually at 90°, to allow placing elongated elements, or plastic hollow corrugated elements for inserting electric plants, said basic element concurring to make a modular caisson for a mono-directional or reticular floor composed of a series of basic elements abutted onto a modular element, also with, and mutually spaced in order to define recesses in which reinforcing irons are inserted, into the suitable housings of the connectors that are modular in width and height, and of different types and shapes, and in which concrete is cast in order to form small cross-members of modular width and height measures.

10. The modular structure according to claim 9, wherein the said basic elements have aeration passages connected to holes placed in the connectors that are modular in width and height, the aeration passages and the upper part of each basic element having a tapered shape that allows stacking many basic elements, without further encumbrances, since the upper part of the modular basic element is inserted in the aeration passage of the basic element placed thereover.

11. The modular structure according to claim 1, further comprising a profiled modular element without limits of measures and sections, made of plastic material through extrusion, in order to form a series of longitudinal passages, said profiled modular element having a series of cross-shaped passages adapted to house respective T-shaped bars.

12. The modular structure according to claim 11, wherein the said T-shaped bars have their base fastened to the foundation with a modular braid or bracket, and ensuring stability and resistance to dot-shaped and tangential loads of profiled modular elements.

13. The modular structure according to claim 12, wherein two or more profiled modular elements are mutually connected through cross-shaped brackets, which have four ends hinged to respective fastening brackets, in turn inserted into suitable securing slits.

14. A modular structure for buildings comprising:

a plastic modular element having a honey-comb structure and a plurality of elongated hollow posts extending in a longitudinal direction through an end surface of the modular element, the modular element defining a slot extending from the end surface and at least partially through the modular element in the longitudinal direction, the modular element having an outer face transverse to the end surface;

a series of alternating ribs and recesses defined on the outer face that extend in the longitudinal direction from the end surface; and a bracket having a first bracket member and a second bracket member spaced from the first bracket member, the first bracket member received in one of the recesses in the outer face, and the second bracket member received in the slot in the modular element, enabling the bracket to be slid relative to the modular element along the longitudinal direction.

* * * * *